US011296431B2

(12) United States Patent
Fitzpatrick et al.

(10) Patent No.: US 11,296,431 B2
(45) Date of Patent: Apr. 5, 2022

(54) INLINE CABLE CONNECTOR ASSEMBLY AND METHODS

(71) Applicant: COMMSCOPE, INC. OF NORTH CAROLINA, Hickory, NC (US)

(72) Inventors: Brian J. Fitzpatrick, McKinney, TX (US); Amid Ihsan Hashim, Plano, TX (US)

(73) Assignee: COMMSCOPE, INC. OF NORTH CAROLINA, Hickory, NC (US)

( * ) Notice: Subject to any disclaimer, the term of this patent is extended or adjusted under 35 U.S.C. 154(b) by 0 days.

(21) Appl. No.: 16/343,517

(22) PCT Filed: Oct. 19, 2017

(86) PCT No.: PCT/US2017/057387
§ 371 (c)(1),
(2) Date: Apr. 19, 2019

(87) PCT Pub. No.: WO2018/075769
PCT Pub. Date: Apr. 26, 2018

(65) Prior Publication Data

US 2019/0267724 A1 Aug. 29, 2019

Related U.S. Application Data

(60) Provisional application No. 62/410,976, filed on Oct. 21, 2016.

(51) Int. Cl.
*H01R 4/245* (2018.01)
*H01R 25/00* (2006.01)
(Continued)

(52) U.S. Cl.
CPC ..... *H01R 4/245* (2013.01); *H01R 4/2416* (2013.01); *H01R 13/6463* (2013.01);
(Continued)

(58) Field of Classification Search
CPC .... H01R 25/003; H01R 4/245; H01R 4/2416; H01R 13/6463; H01R 13/506; H01R 43/01; H01R 43/28; H01R 43/20
See application file for complete search history.

(56) References Cited

U.S. PATENT DOCUMENTS 5,498,172 A * 3/1996 Noda ..... H01R 12/616 439/404
5,947,761 A * 9/1999 Pepe ..... H01R 4/2433 439/409
(Continued)

FOREIGN PATENT DOCUMENTS

CN 1241825 A 1/2000
CN 102165643 A 8/2011
(Continued)

OTHER PUBLICATIONS

First Chinese Office Action for Chinese Patent Application No. 201780064315.4 dated Jan. 2, 2020, 18 pages.
(Continued)

*Primary Examiner* — Briggitte R. Hammond
(74) *Attorney, Agent, or Firm* — Merchant & Gould P.C.

(57) ABSTRACT

An inline cable connector assembly connects one or more twisted pairs of wire leads of a first cable to one or more twisted pairs of wire leads to a second cable. The assembly includes first and second terminal housing parts, first and second wiring caps, and double ended insulation displacement contacts within the connector assembly.

14 Claims, 22 Drawing Sheets

(51) Int. Cl.

| | |
|---|---|
| ***H01R 43/01*** | (2006.01) |
| ***H01R 4/2416*** | (2018.01) |
| ***H01R 13/6463*** | (2011.01) |
| ***H01R 43/20*** | (2006.01) |
| ***H01R 43/28*** | (2006.01) |
| ***H01R 13/506*** | (2006.01) |

(52) U.S. Cl.
CPC ..... *H01R 25/003* (2013.01); *H01R 43/01* (2013.01); *H01R 43/20* (2013.01); *H01R 43/28* (2013.01); *H01R 13/506* (2013.01)

(56) References Cited

U.S. PATENT DOCUMENTS

| | | | | |
|---|---|---|---|---|
| 6,024,597 | A | 2/2000 | Lok | |
| 6,309,240 | B1 | 10/2001 | Daoud | |
| 6,375,517 | B1 | 4/2002 | Okabe et al. | |
| 6,592,395 | B2 * | 7/2003 | Brown | H01R 4/2429 439/405 |
| 7,223,115 | B2 | 5/2007 | Hashim et al. | |
| 7,322,847 | B2 | 1/2008 | Hashim et al. | |
| 7,568,938 | B2 * | 8/2009 | Siev | H01R 4/2429 439/404 |
| 7,604,515 | B2 * | 10/2009 | Siemon | H01R 13/6463 439/676 |
| 8,215,980 | B1 | 7/2012 | Lin | |
| 8,454,378 | B2 * | 6/2013 | Osterhart | H01R 24/84 439/284 |
| 9,149,858 | B2 * | 10/2015 | Keswani | H01R 4/2404 |
| 9,590,339 | B2 * | 3/2017 | Oberski | H01R 12/718 |
| 2008/0293289 | A1 | 11/2008 | Siev et al. | |
| 2013/0203282 | A1 | 8/2013 | Engels et al. | |

FOREIGN PATENT DOCUMENTS

| | | | |
|---|---|---|---|
| CN | 205051059 | U | 2/2016 |
| EP | 2 996 201 | A1 | 3/2016 |
| KR | 10-2004-0045672 | A | 6/2004 |
| WO | 2014/182562 | A1 | 11/2014 |

OTHER PUBLICATIONS

Extended European Search Report for European Patent Application No. 17862989.5 dated Apr. 23, 2020, 15 pages.

International Search Report and Written Opinion of the International Searching Authority for International Patent Application No. PCT/US2017/057387 dated Jan. 19, 2018, 11 pages.

Chinese Office Action for Chinese Patent Application No. 201780064315.4 dated Aug. 11, 2020, 18 pages.

* cited by examiner

INLINE CABLE CONNECTOR ASSEMBLY AND METHODS

CROSS-REFERENCE TO RELATED APPLICATION

This application is a National Stage Application of PCT/US2017/057387, filed on Oct. 19, 2017, which claims the benefit of U.S. Patent Application Ser. No. 62/410,976, filed on Oct. 21, 2016, the disclosures of which are incorporated herein by reference in their entireties. To the extent appropriate, a claim of priority is made to each of the above disclosed applications.

TECHNICAL FIELD

This disclosure relates to devices for connecting or splicing wire cables to one another. In particular, this disclosure relates to a cable connector assembly for connecting one or more pairs of wire leads of a first cable to one or more pairs of wire leads of a second cable.

BACKGROUND

Inline devices for connecting or splicing two cables carrying pairs of twisted wire leads are generally known.

What is needed is an inline copper connector that will use double ended insulation displacement contacts (IDC) with an offset. This connector could be used to connect horizontal cable to cordage with a factory-terminated plug on one end, fulfilling a similar need as would a field-terminable plug connector. This connector can be located away from the attached device, which means space is not constrained, allowing the connector to be larger and easier to terminate.

SUMMARY

In accordance with principles of this disclosure, an inline cable connector assembly for connecting one or more pairs of wire leads of a first cable to corresponding one or more pairs of wire leads of a second cable is provided. The connector assembly includes a terminal housing structure including a first base, and a second base facing a direction opposite of the first base. The connector assembly includes wiring cap structure including first and second wiring caps. The first wiring cap is oriented to engage against the first base, and the second wiring cap is oriented to engage against the second base. The connecting assembly also includes one or more pairs of double ended insulation displacement contacts (IDC) within the connector assembly.

In some arrangements, the double ended insulation displacement contacts are operably held within the terminal housing structure.

In some arrangements, the first and second housing parts are latched together.

In some arrangements, the double ended insulation displacement contacts are operably held within the wiring cap structure.

In some embodiments, the first and second wiring caps are latched together.

In some embodiments, the terminal housing structure and the wiring cap structure together form an assembly housing. The assembly housing includes opposite first and second sides, each of the first and second sides having an interlock arrangement to allow for selective removable interlocking of an adjacent assembly housing.

The interlock arrangement may include a projection in one of the first and second sides and a projection-receiving group in the other of the first and second sides.

In one or more embodiments, the first wiring cap is a snap-fit engagement with the first housing part, and the second wiring cap is a snap-fit engagement with the second housing part.

In preferred implementations, the snap-fit engagement between the first and second wiring caps and the first and second housing parts is disengageable with a screw driver.

In some implementations, the first terminal housing part has an open sided aperture for allowing entry of the first cable, and the second terminal housing part has an open sided aperture for allowing entry of the second cable.

In some implementations, the first terminal housing part has a closed aperture for allowing entry of the first cable, and the second terminal housing part has a closed aperture for allowing entry of the second cable.

In some embodiments, the snap fit engagement is accomplished with the use of standard pliers.

In another aspect, an inline cable connector assembly for connecting one or more pairs of wire leads of a first cable to corresponding one or more pairs of wire leads of a second cable includes a housing; and at first and second rows of double-ended insulation displacement contacts held by the housing, each of the contacts having two oppositely directed wire connecting portions electrically connected with an integral jog intermediate the wire connecting portions.

In preferred implementations, the connector assembly is compliant with Category 6A.

In another aspect, a method of connecting first one or more pairs of wire leads of a first cable to second one or more pairs of wire leads of a second cable is provided. The method includes lacing a first one or more pairs of wire leads into a first base; lacing a second one or more pairs of wire leads into a second base, the second base facing a direction opposite of the first base; providing a first wiring cap against the first base; providing a second wiring cap against the second base; and compressing the assembly of the first base, first wiring cap, second base, and second wiring cap so that a plurality of double ended insulation displacement contacts within the assembly penetrate the wire leads and electrically connect the first four pairs to the second four pairs.

A variety of additional inventive aspects will be set forth in the description that follows. The inventive aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated herein and constitute a part of the description, illustrate several aspects of the present disclosure. A brief description of the drawings is as follows.

DETAILED DESCRIPTION

The inline cable connector assembly of FIGS. 1-23 creates an inline copper connector. The connector can be used to connect a horizontal twisted pair cable to cordage with a factory-terminated plug on one end. As this connector can be located away from the attached device, space is not constrained, allowing the connector to be larger and easier to terminate.

Figure 1:
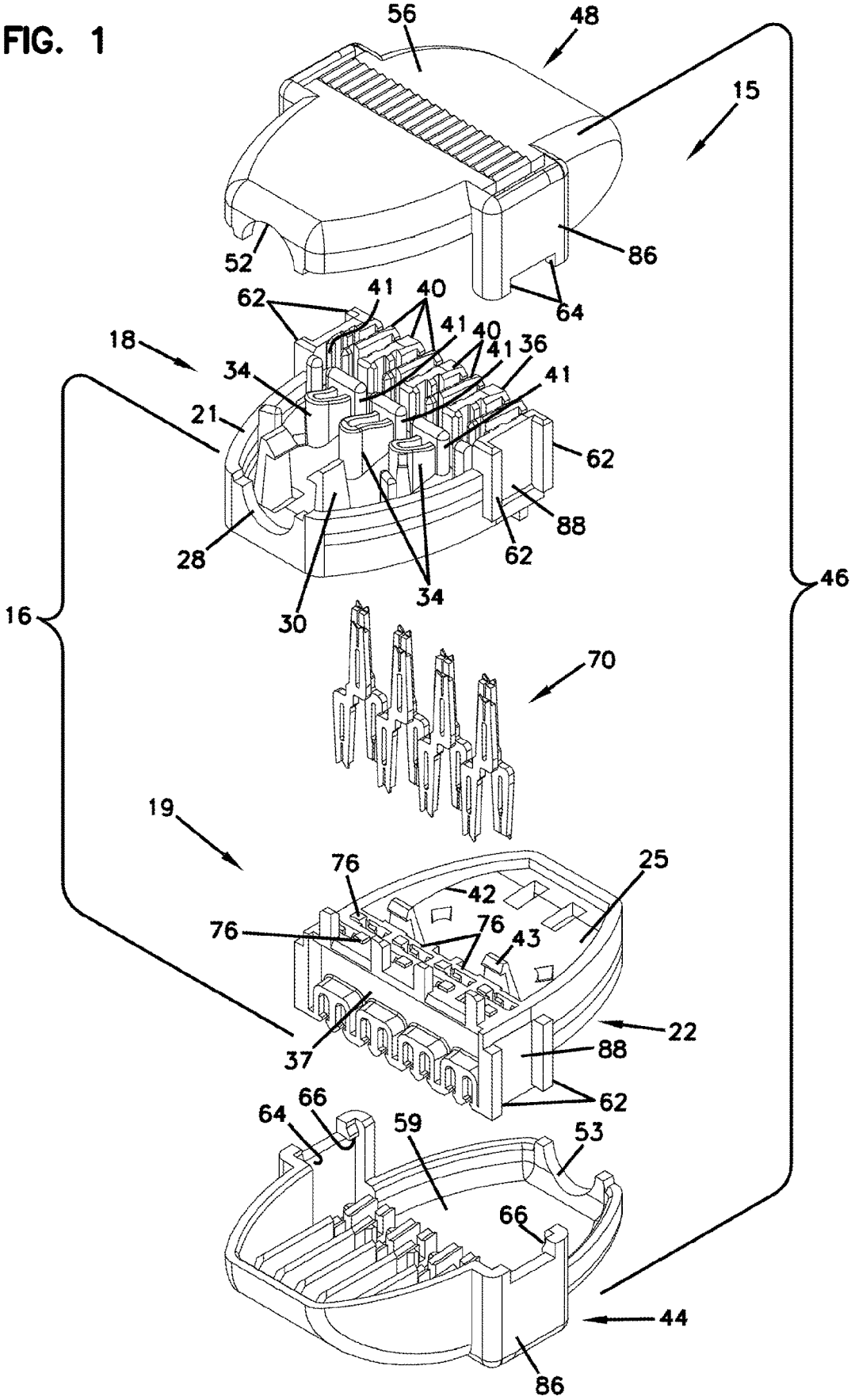
FIG. 1 is an exploded perspective view of a first embodiment of an inline cable connector assembly for connecting a first four pairs of wire leads of a first cable to a second four pairs of wire leads of a second cable, constructed in accordance with principles of this disclosure.
Figure 2:
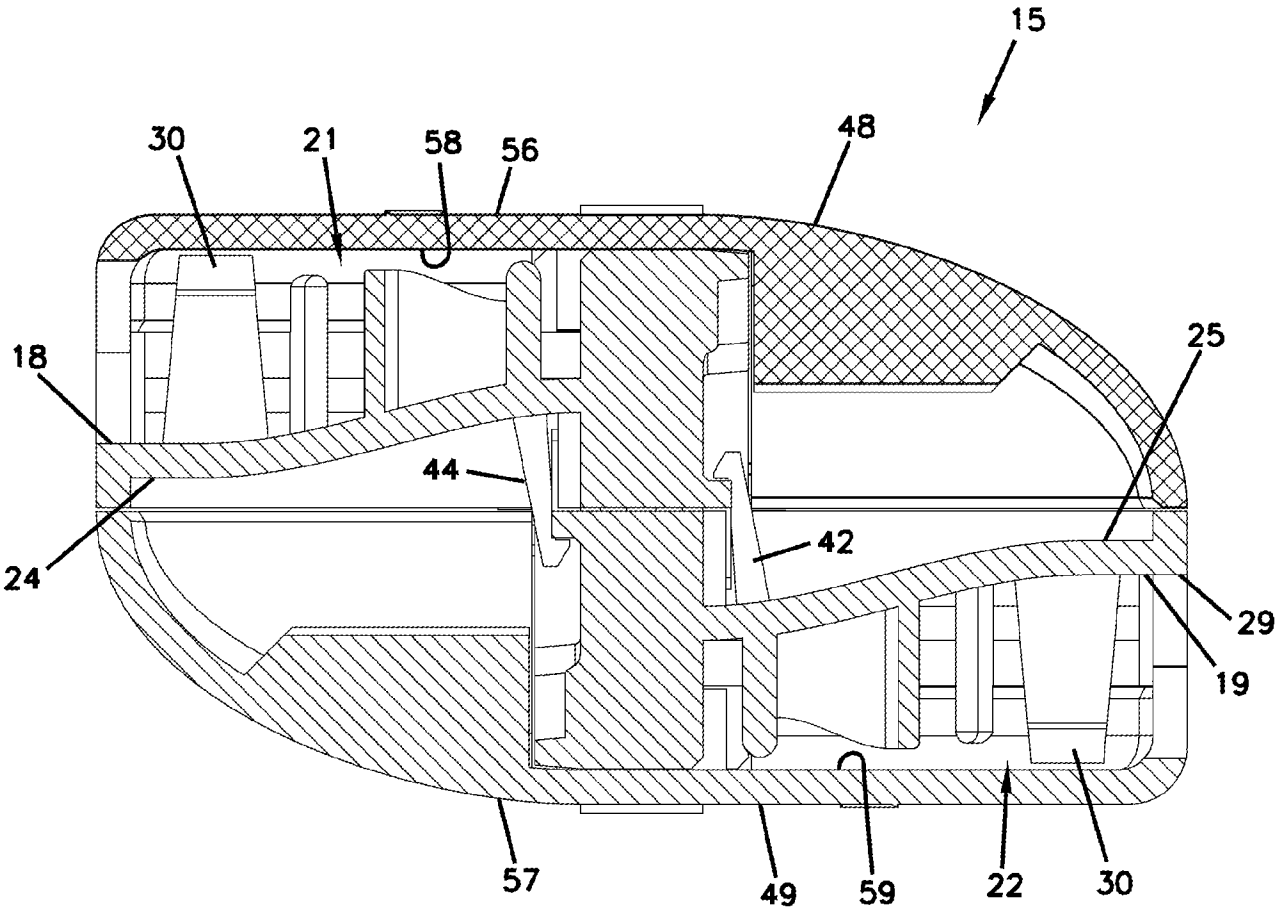
FIG. 2 is a cross-sectional view of the assembly connector assembly of FIG. 1 and showing the first and second terminal housing parts latched together.

FIG. 1 illustrates a first embodiment of connector assembly at 15. The assembly 15 includes a terminal housing structure 16 including a first terminal housing part 18 and a second terminal housing part 19. The first terminal housing part 18 and second terminal housing part 19 are substantially identical to each other.

The first terminal housing part 18 has a first base 21, which receives a first cable having four twisted pairs of wire leads. The second terminal housing part 19 has a second base 22 that receives a second cable having four pairs of twisted wire leads. In FIG. 1, the first base 21 and second base 22 are faced in opposite directions. In FIG. 1, the first base 21 of the first terminal housing part 18 can been seen, while the second base 22 cannot be seen. However, it should be understood that the second base 22 is identical in appearance to the first base 21. Opposite the first base 21 is first side 24, while opposite the second base 22 is second side 25. The second side 25 in FIG. 1 is visible, while the first side 24 is not visible in FIG. 1. It should be understood that the first side 24 is substantially identical in appearance to the second side 25.

Both the first terminal housing part 18 and second terminal housing part 19 include an open sided aperture 28, 29 which is shaped to allow a cable to be laid within the respective housing part 18, 19. The cradle shape of the open sided aperture 28, 29 will hold the cable and allows the cable to be laid on the base 21, 22 freely and without having to thread the cable through any closed holes or apertures.

Figure 3:
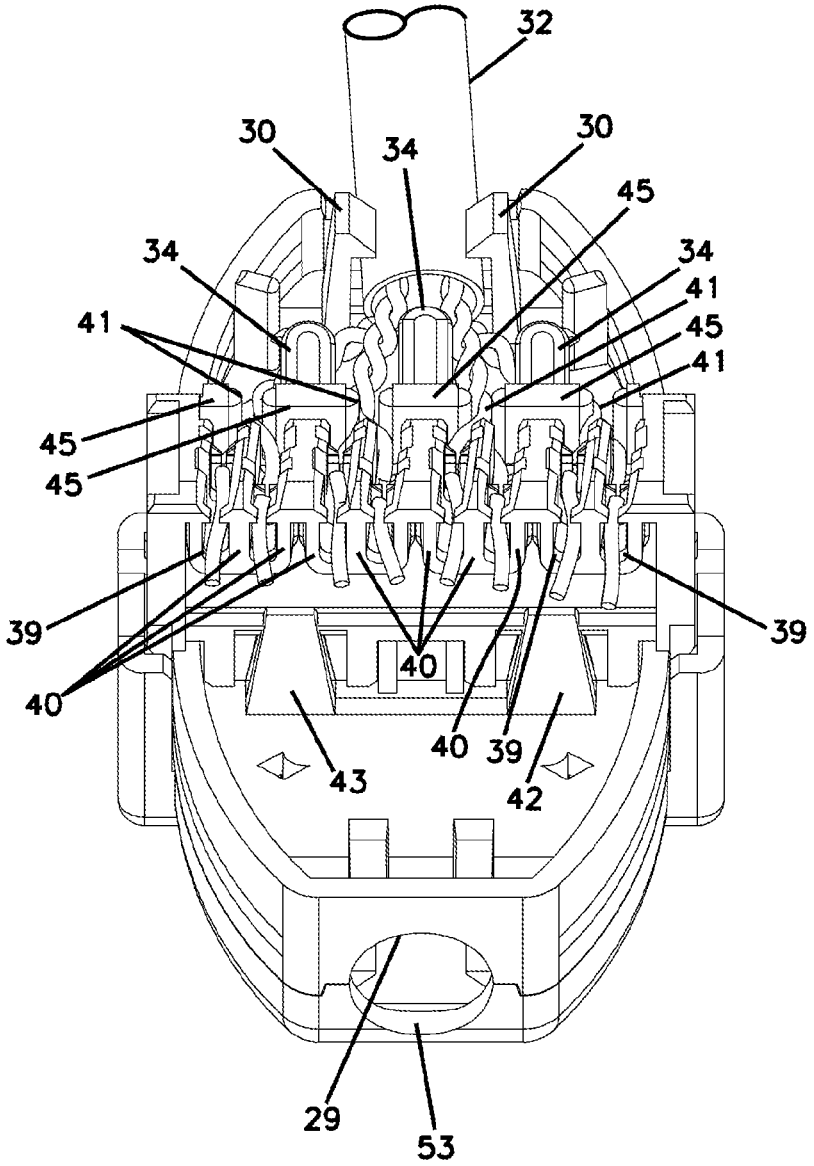
FIG. 3 is a perspective view showing the connector assembly of FIG. 1 assembled and with the top wiring cap removed such that the lacing of four pairs of wire leads of a first cable can be seen.

The first and second bases 21, 22 further include a pair of hooked latches 30 opposing each other, such that when the cable is laid on the base 21, 22, the hooked latches 30 will help hold the cable in the base 21, 22. FIG. 3 illustrates a pair of the hooked latches 30 holding a cable 32 in place.

Other structure in the bases 21, 22 can be seen by studying FIGS. 1 and 3, in which it should be understood that the first base 21 and second base 22 are identical, so that a description for one base applies to both bases. Each base 21, 22 includes three spacers 34 projecting from the base 21, 22 and spaced apart from each other. As can be seen in FIG. 3, the three spacers 34 function to separate and space apart each twisted pair in the cable 32.

The first housing part 18 has an end wall 36 that is the wall opposite of the cable intake having the open sided aperture 28. Similarly, the second terminal housing part 19 has an end wall 37, which is the wall opposite of where the cable enters. Between the spacers 34 and the respective end wall 36, 37, the base 21, 22 includes lead spacers 40, which space and hold the individual leads (wires) in each twisted pair. The lead spacers 40 hold each lead in place and allow it to be electrically connected to the leads in the other cable, when pressed together with the insulation displacement contacts. This is described further below.

As can be appreciated from a review of FIG. 3, the construction of the base 21, 22 allows each twisted pair to remain twisted until after passing the spacers 34. Thus, the leads are only separated and individualized for a very short distance, such as under 4 millimeters. This has advantages in that maintaining the twisted pairs in the twists helps to maintain balance and avoid cross-talk. In FIGS. 1 and 3, slots 41 formed between spacers 45 hold each twisted pair and prevent it from untwisting behind the slots 41. An installer adds twist to each twisted pair to position it such that either the colored or white wire is on top as the pair is inserted into the slot 41. On one side of the connector 15, the colored wire should be on top; on the other side, the white wire should be on top, as explained in connection with FIGS. 15 and 16 below. In this embodiment, there are four slots 41, one for each twisted pair. Downstream of and next to the four slots 41 are eight slots 39, which are between the lead spacers 40. The slots 39 hold the individual leads (wires) in each twisted pair.

The first and second sides 24, 25 of the housing parts 18, 19 include structure to allow it to be connected to the other housing part. For example, in FIG. 1, the connecting structure for second side 25 can be seen as latches 42, 43. The latches 42, 43 engage the first terminal housing part 18 to provide a connection therewith. Similarly, the first side 24 of the first housing part also has a pair latches, one of which being shown at 44 in FIG. 2. The latch 44 engages the second terminal housing part 19.

In accordance with the principles of this disclosure, the connector assembly 15 includes wiring cap structure 46. The wiring cap structure 46 includes a first wiring cap 48 and a second wiring cap 49 that are substantially identical to each other. The first wiring cap 48 is oriented to engage against the first base 21 of the first housing part 18. The second wiring cap 49 is oriented to engage against the second base 22 of the second housing part 19. Each of the first and second wiring caps 48, 49 includes a cable entry port 52, 53. When the first and second wiring caps 48, 49 are operably attached to the first and second terminal housing parts 18, 19, the cable entry port 52 is aligned with the open sided aperture 28, while the cable entry port 53 is aligned with the open side aperture 29. Together, this forms a closed cable entry port that holds each cable as it is entering into the connector assembly 15.

Each of the first and second wiring caps 48, 49 has an exterior portion 56, 57 and an opposite housing part engaging portion 58, 59. The housing part engaging portion 58, 59 faces each respective base 21, 22 and engages against the housing part 18, 19 such when a compressive force is applied, an electrical connection is made between each lead of the four twisted pairs in the cable.

The first wiring cap 48 is in slidable engagement with the first terminal housing part 18. The second wiring cap 49 is in slidable engagement with the second terminal housing part 19. The slidable engagement is accomplished by slide rails 62 projecting from the side wall of the first and second terminal housing parts 18, 19. The slide rails 62 are received within receiving grooves 64 in the wiring caps 48, 49. Ends of the receiving grooves 64 have an inwardly projecting tab 66 that snaps over the end of the rails 62 to help hold the wiring caps 48, 49 together to the housing parts 18, 19. It should be understood that many types of attachment structures are possible, and the position of the rails and grooves could be easily reversed.

Figure 5:
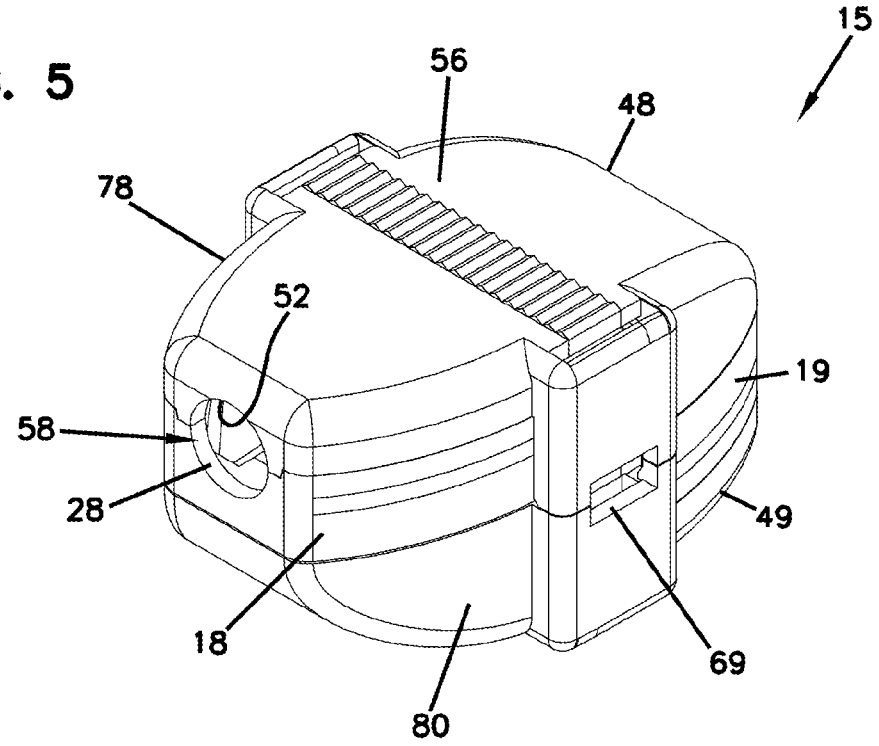
FIG. 5 is an upper perspective view of the connector assembly of FIG. 1.
Figure 6:
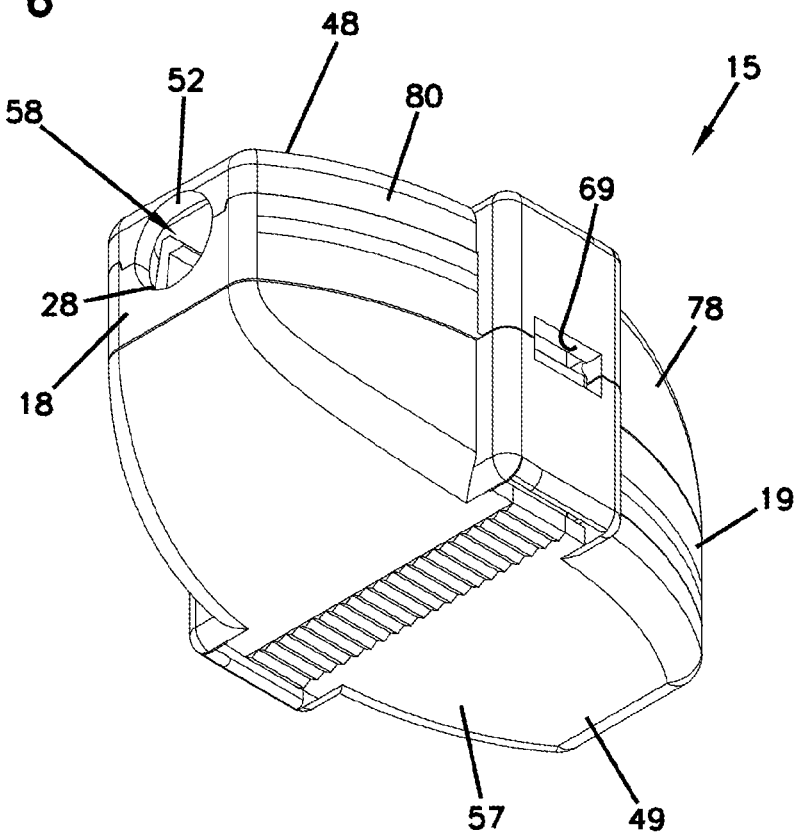
FIG. 6 is a lower perspective view of the connector assembly of FIG. 1.
Figure 7:
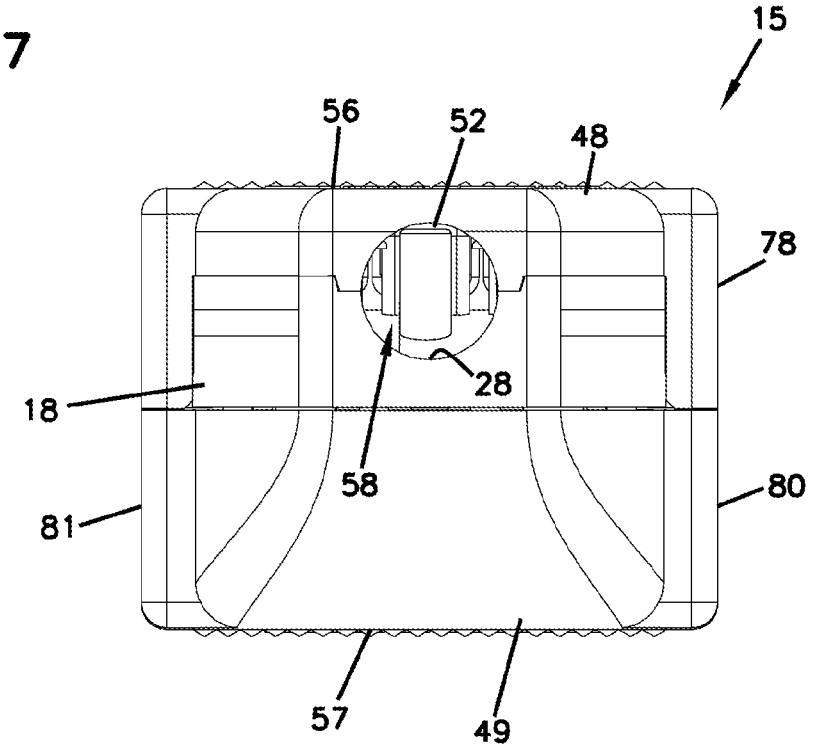
FIG. 7 is a left side view of the connector assembly of FIG. 5.
Figure 8:
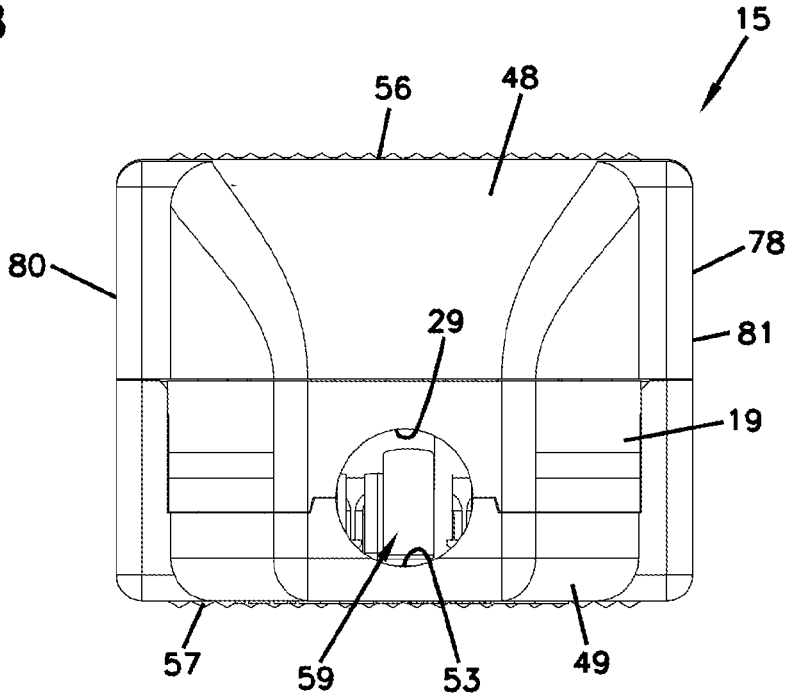
FIG. 8 is a right side view of the connector assembly of FIG. 5.
Figure 9:
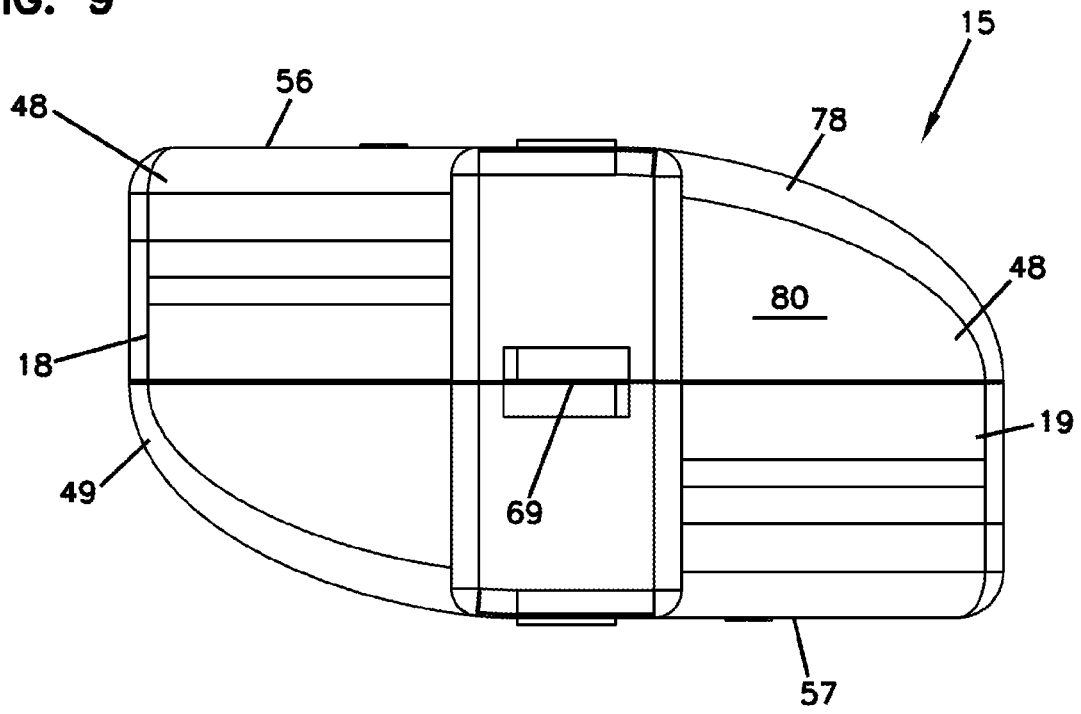
FIG. 9 is a front view of the connector assembly of FIG. 5.
Figure 10:
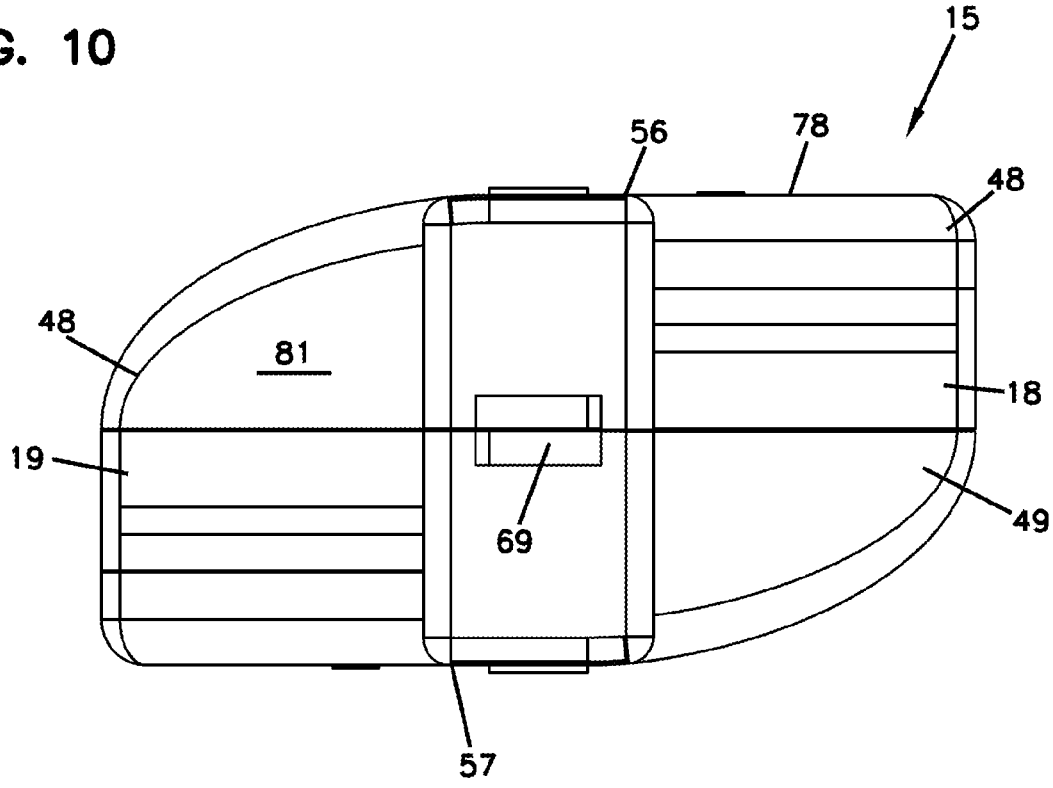
FIG. 10 is a rear view of the connector assembly of FIG. 5.

Typically, it would not take a specialized tool to provide the slidable and snap fitting engagement between the first wiring cap 48 and first terminal housing part 18, as well as between the second wiring cap 49 and the second terminal housing part 19. Rather, the snap fitting engagement can be accomplished with the use of standard pliers. The snap fitting engagement can be disengaged with a standard screwdriver along the slot 69 (FIGS. 5 and 6). Such a construction results in an inline cable connector assembly 15 which is field terminable.

Figure 4:
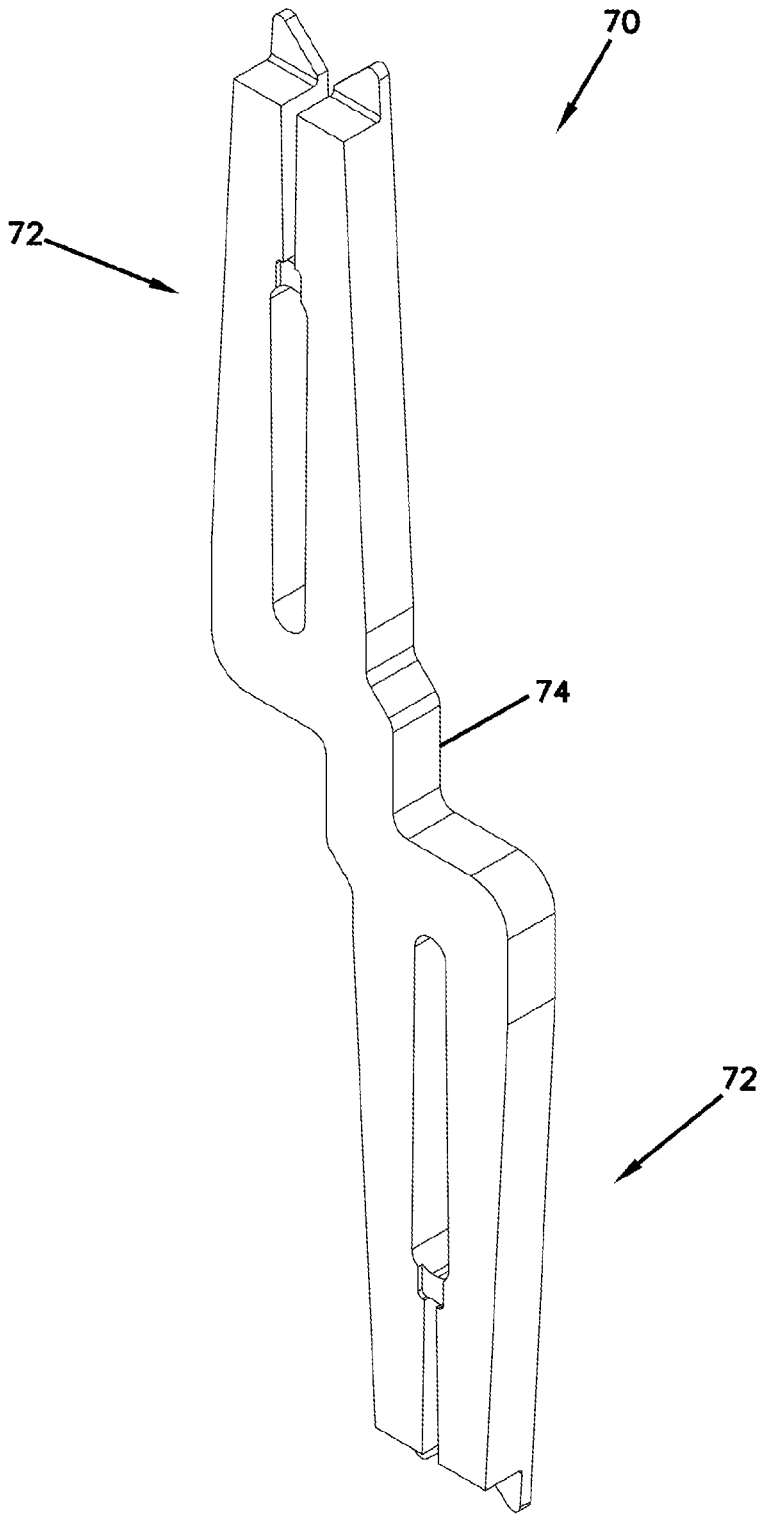
FIG. 4 is a perspective view of one of the double ended insulation displacement contacts used in the connector assembly of FIG. 1.

In accordance with principles of this disclosure, the connector assembly 15 includes a plurality of double ended insulation displacement contacts 70 (IDC) within the connector assembly 15. An enlarged view of one type of usable IDC is shown in FIG. 4. Each of the contacts 70 has two oppositely directed wire connecting portions 72 which are electrically connected via an integral jog or step 74 formed intermediately relative to the wire connecting portions 72. In the connector assembly 15, there are eight contacts 70, one for each wire lead of the four twisted pairs.

Figure 26:
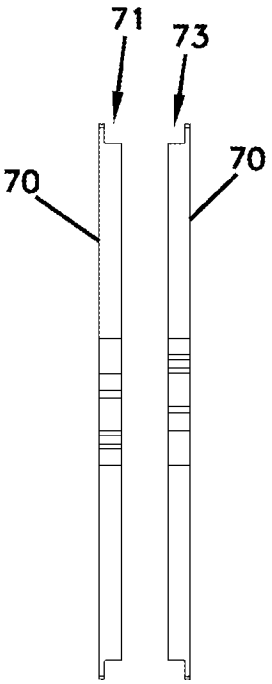
FIG. 26 is a side view of the insulation displacement contacts of FIG. 25.
Figure 25:
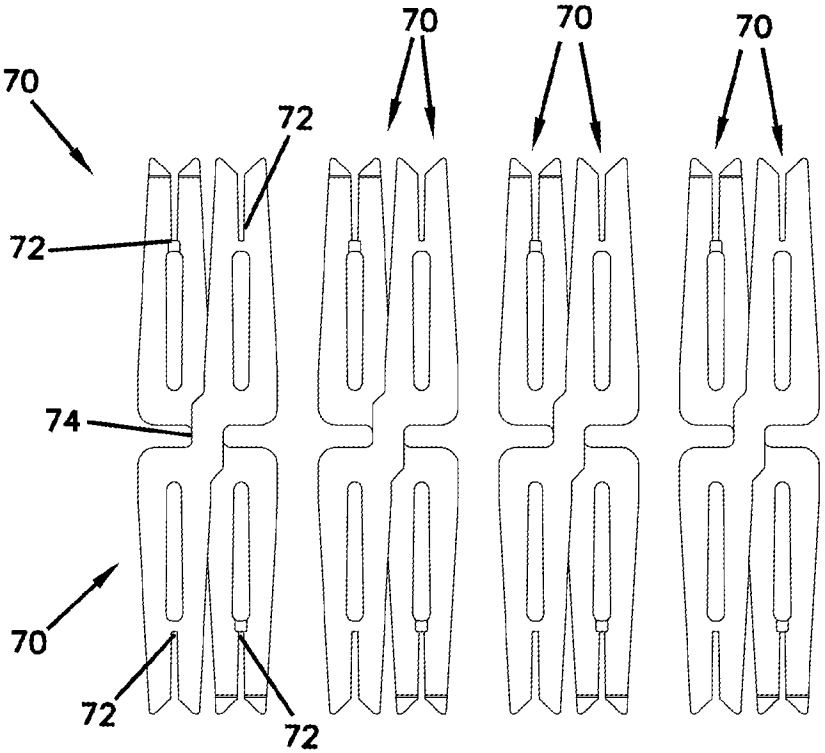
FIG. 25 is a front plan view of the insulation displacement contacts used for the connector assemblies of the above.

Attention is directed to FIGS. 25 and 26, which show the IDCs 70 arranged in two generally parallel rows 71, 73. The IDCs 70 can be held in any of the housings described herein. The first and second rows 71, 73 of the double-ended insulation displacement contacts 70 are held within the housing, and each of the contacts 70 has two oppositely directed wire connecting portions 72 electrically connected with an integral jog 74 intermediate the wire connecting portions 72.

In the embodiment of FIG. 1, the first terminal housing part 18 and second terminal housing part 19 have through-slots 76 to receive and hold one of the contacts 70. In FIG. 1, the slots 76 are arranged in two rows, having four slots 76 each. The steps or jogs 74 are captured between the housing parts 18, 19. When the housing parts 18, 19 each have a cable that is laced within it as shown in FIG. 3, when the first and second wiring caps 48, 49 are compressed in a direction towards each other, the squeezing or compressive force will cause each lead to have the insulation displaced and to make electrical contact with one of the respectively positioned contacts 70. The lead that is to be spliced with each lead also makes electrical contact with the same contact, which then electrically connects each lead to the corresponding lead in the other cable.

Figure 15:
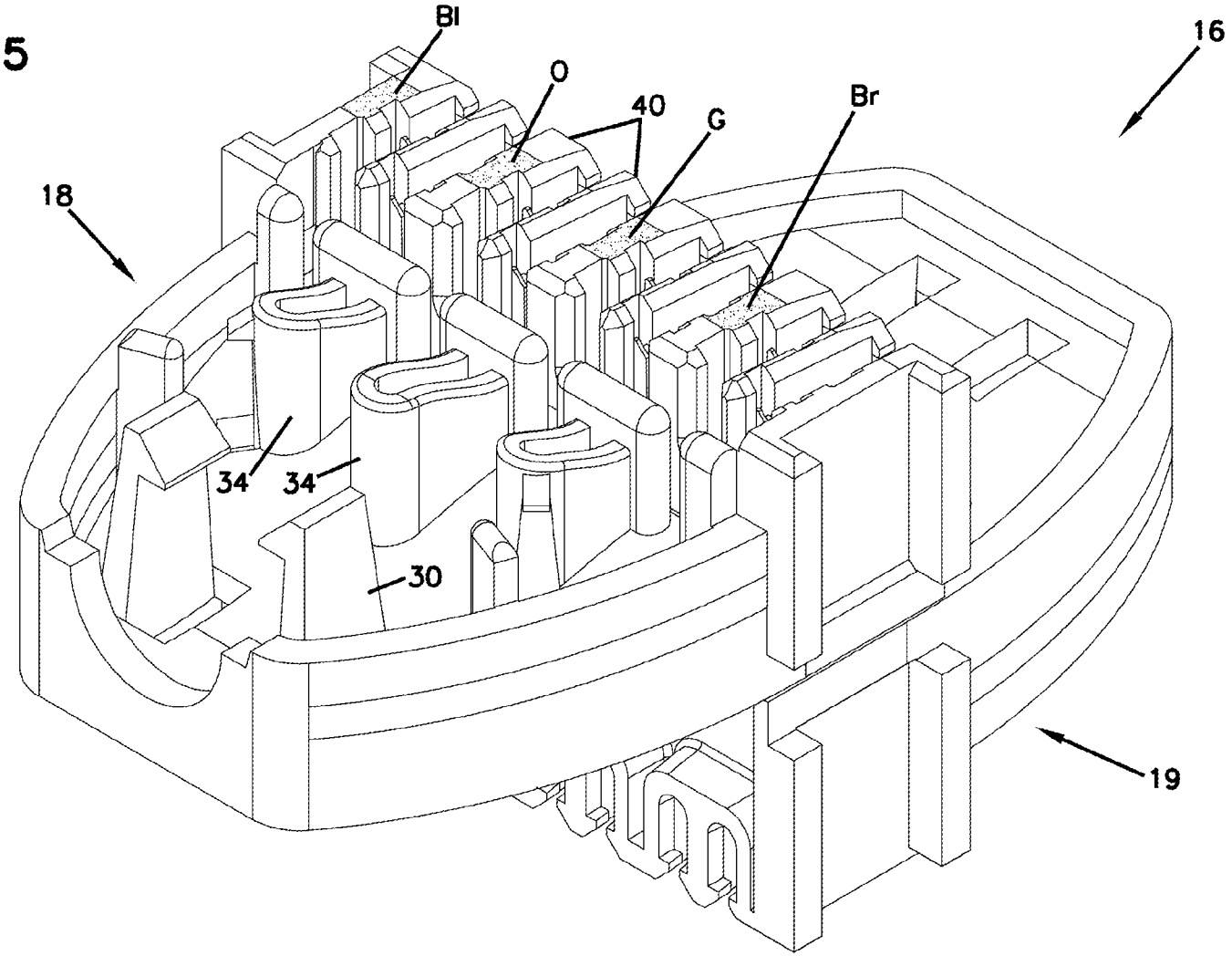
FIG. 15 is a top perspective view of the terminal housing structure of the embodiment of FIG. 1, with the first and second terminal housing parts secured together, and depicting a wiring order system.
Figure 16:
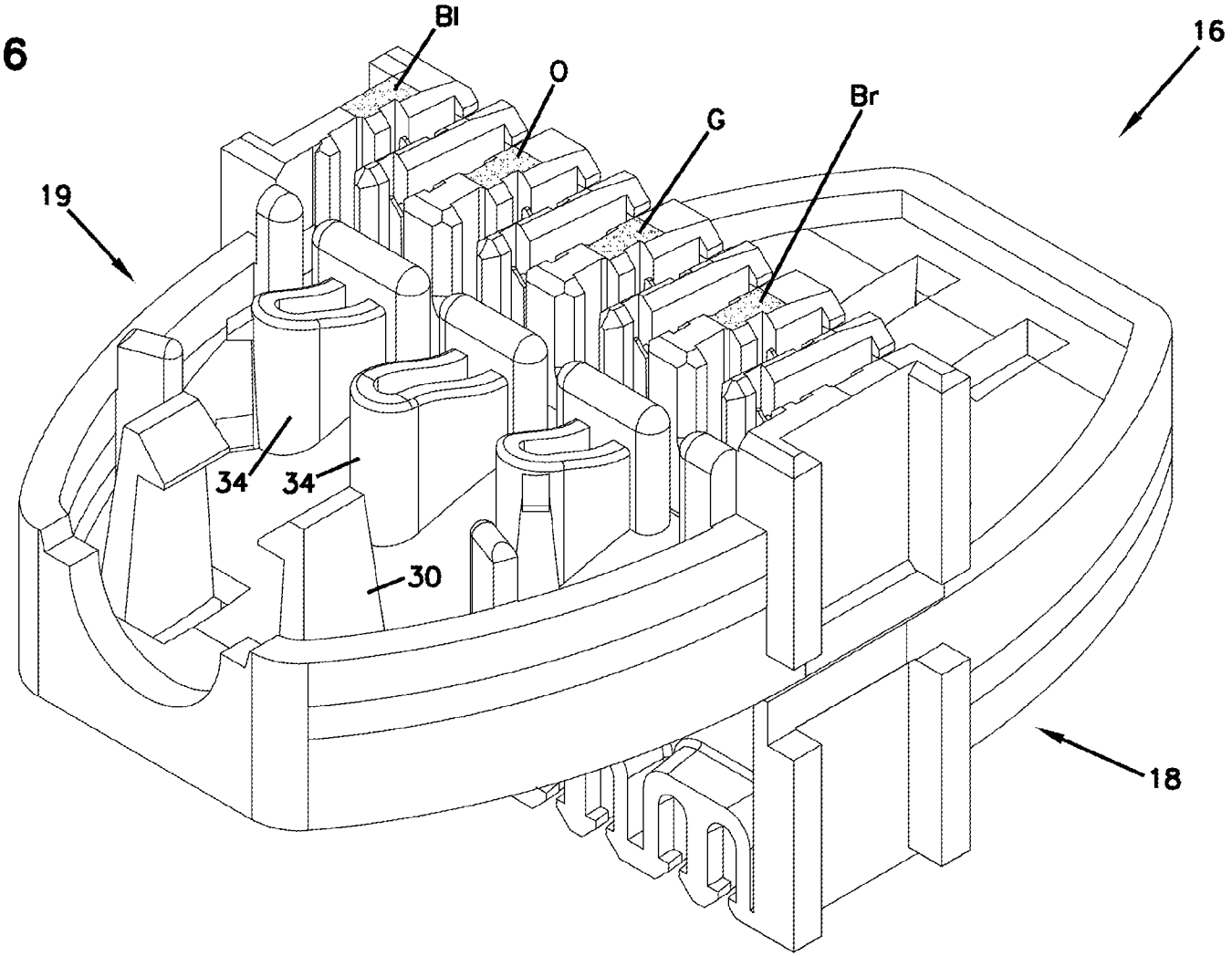
FIG. 16 is a bottom perspective view of the terminal housing structure of FIG. 15, with the first and second terminal housing parts secured together, and depicting a wiring order system.
Figure 17:
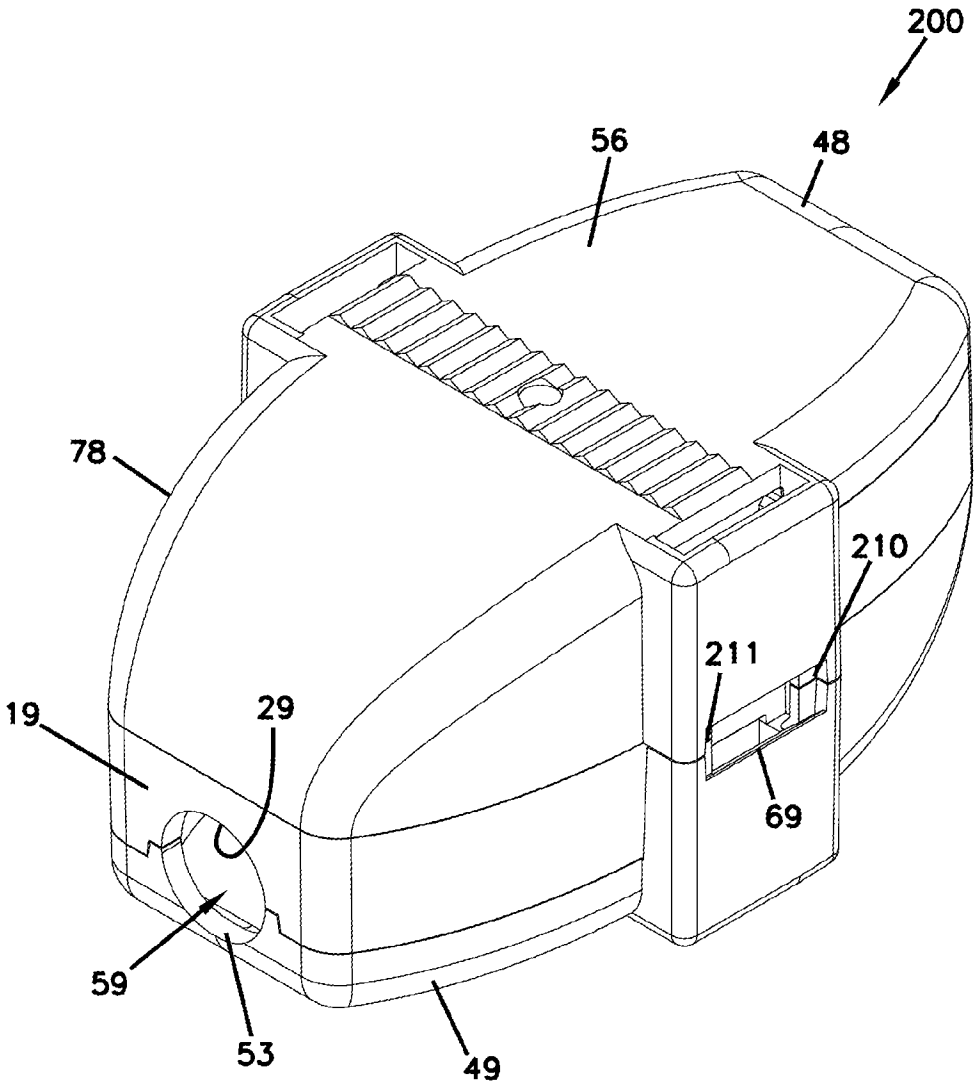
FIG. 17 is a perspective view of another embodiment of a connector assembly.
Figure 18:
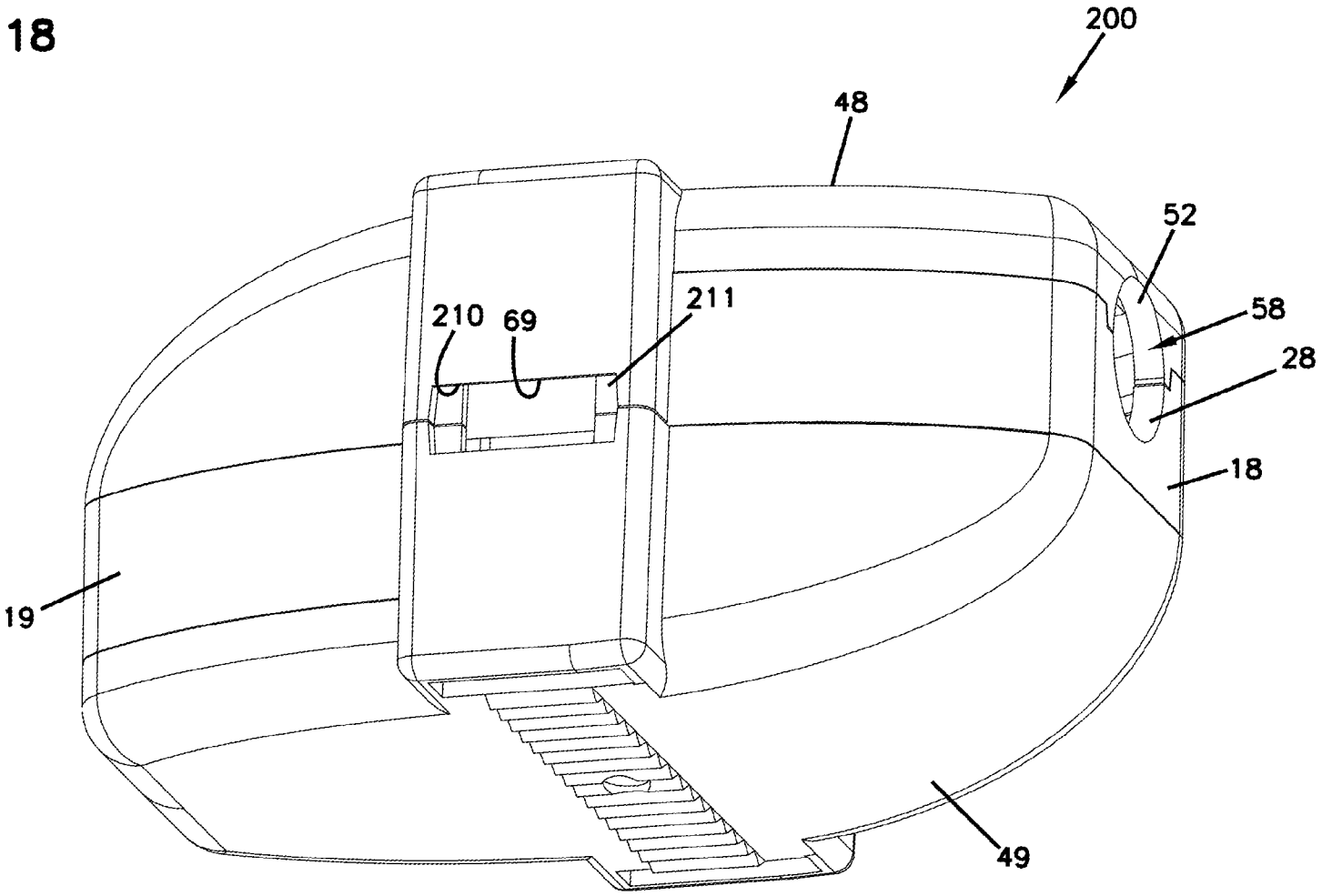
FIG. 18 is another perspective view of the connector assembly of FIG. 17.
Figure 19:
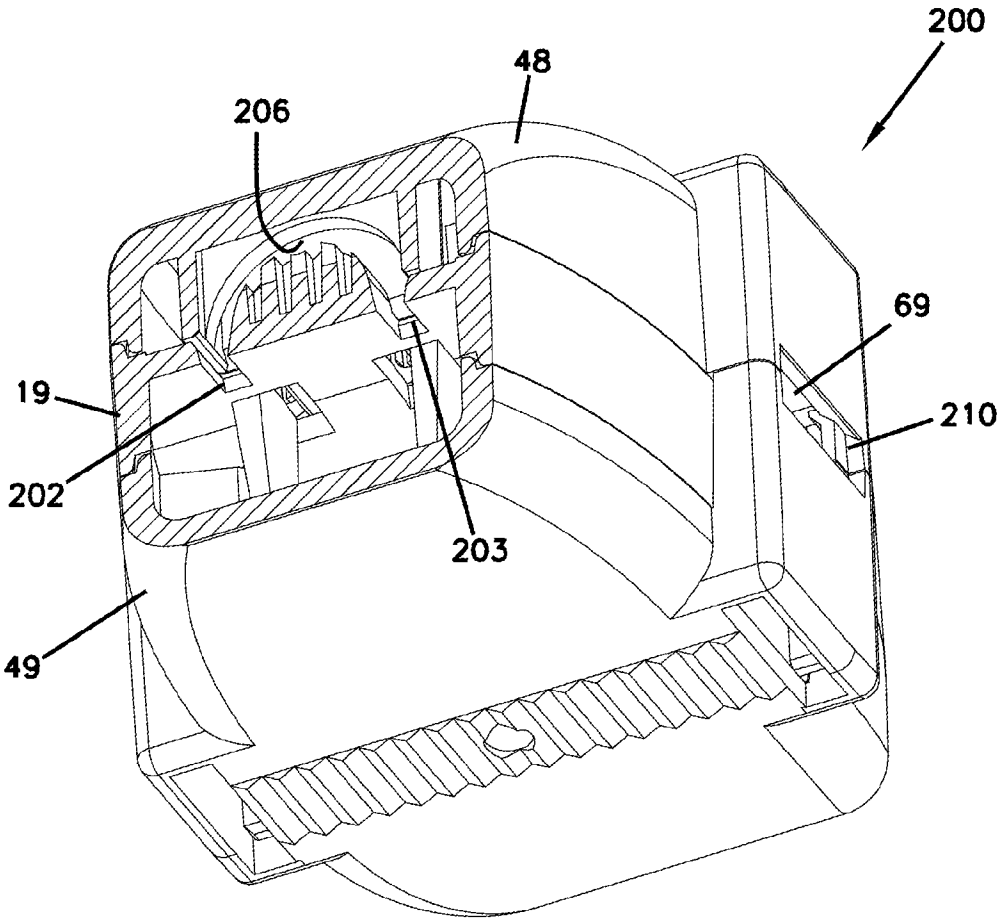
FIG. 19 is a partial cross-sectional perspective view of the connector assembly of FIGS. 17 and 18.
Figure 20:
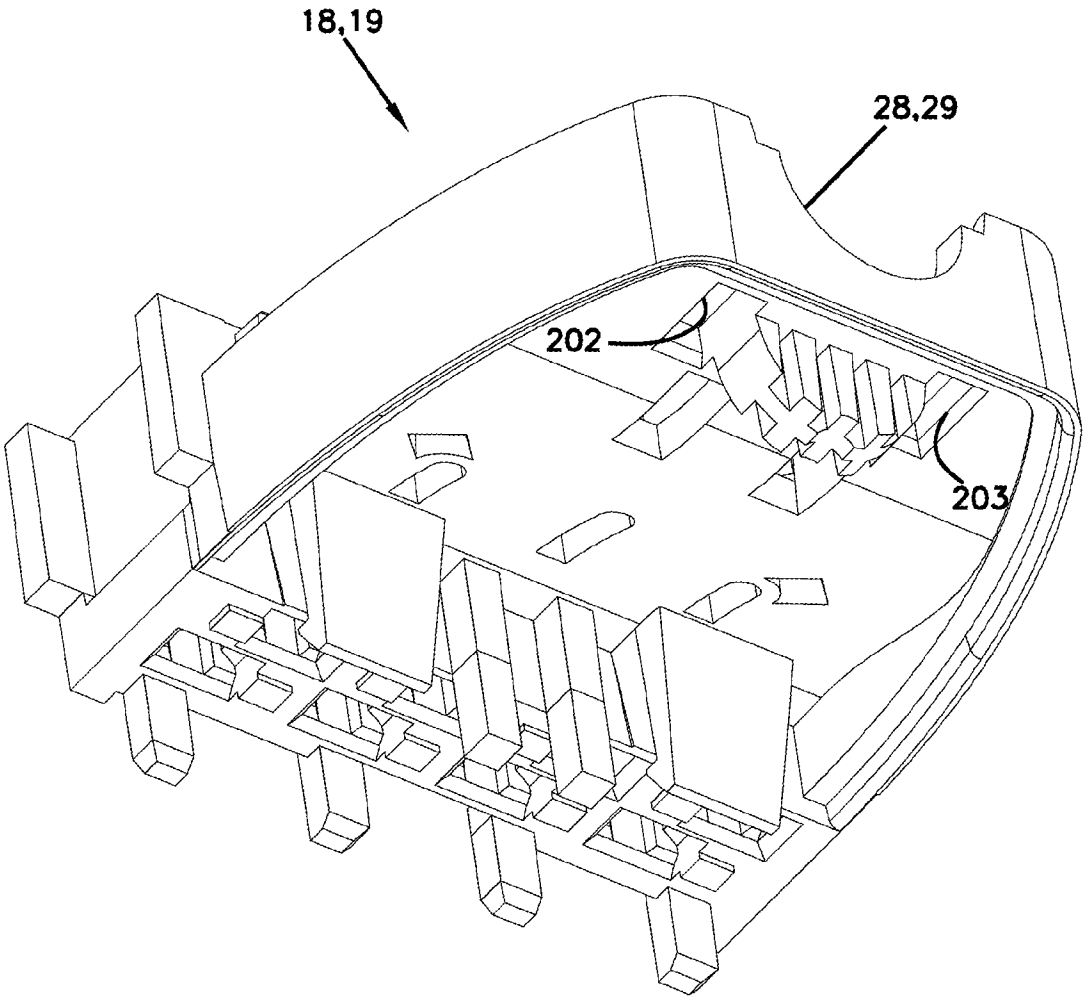
FIG. 20 is a perspective view of a terminal housing part used in the connector assembly of FIGS. 17-19.

FIGS. 15 and 16 are perspective views of the terminal housing structure 16, with the first 18 and second 19 terminal housing parts secured together. Each of the first 18 and second 19 terminal housing parts can include a visual marking system to communicate to the technician how to wire the twist pairs, in order to make sure that when the two cables are spliced, the correct electrical connections are made a wiring order system. Many embodiments are possible, and in the example shown, the spacers 40 can be indicated with colors or other symbols to indicate which individual wire lead should be placed in the spacer. For example, the spacers can be colored to show blue at Bl, orange at O, green at G, and brown at Br. The corresponding white wire leads would be in between. Because of the jog of step 74 in the IDCs, the wiring is not identical in the first terminal housing part 18 and second terminal housing part 19, but is shifted.

FIGS. 5-10 illustrate various views of the connector assembly 15 in a finished connection. The cable entry ports 58, 59 can be seen on opposite ends of the assembly 15. The terminal housing structure 16 and the wiring cap structure 46 together form an assembly housing 78. The assembly housing 78 includes opposite first and second sides 80, 81 which are between the ends having the cable entry ports 58, 59.

In accordance with principles of this disclosure, each of the first and second sides 80, 81 has a connection arrangement to allow for selective removable connection to an adjacent assembly housing 78. In the embodiment of FIGS. 1-11, adjacent housings 78 can be secured by a tether or tie, such as a zip tie 84. The zip tie 84 extends in the space between the wall 86 (FIG. 1) of the wiring caps 48, 49 forming the receiving grooves 64 and the wall 88 (FIG. 1) of the first and second housing parts 18, 19 between the slide rails 62.

Figure 11:
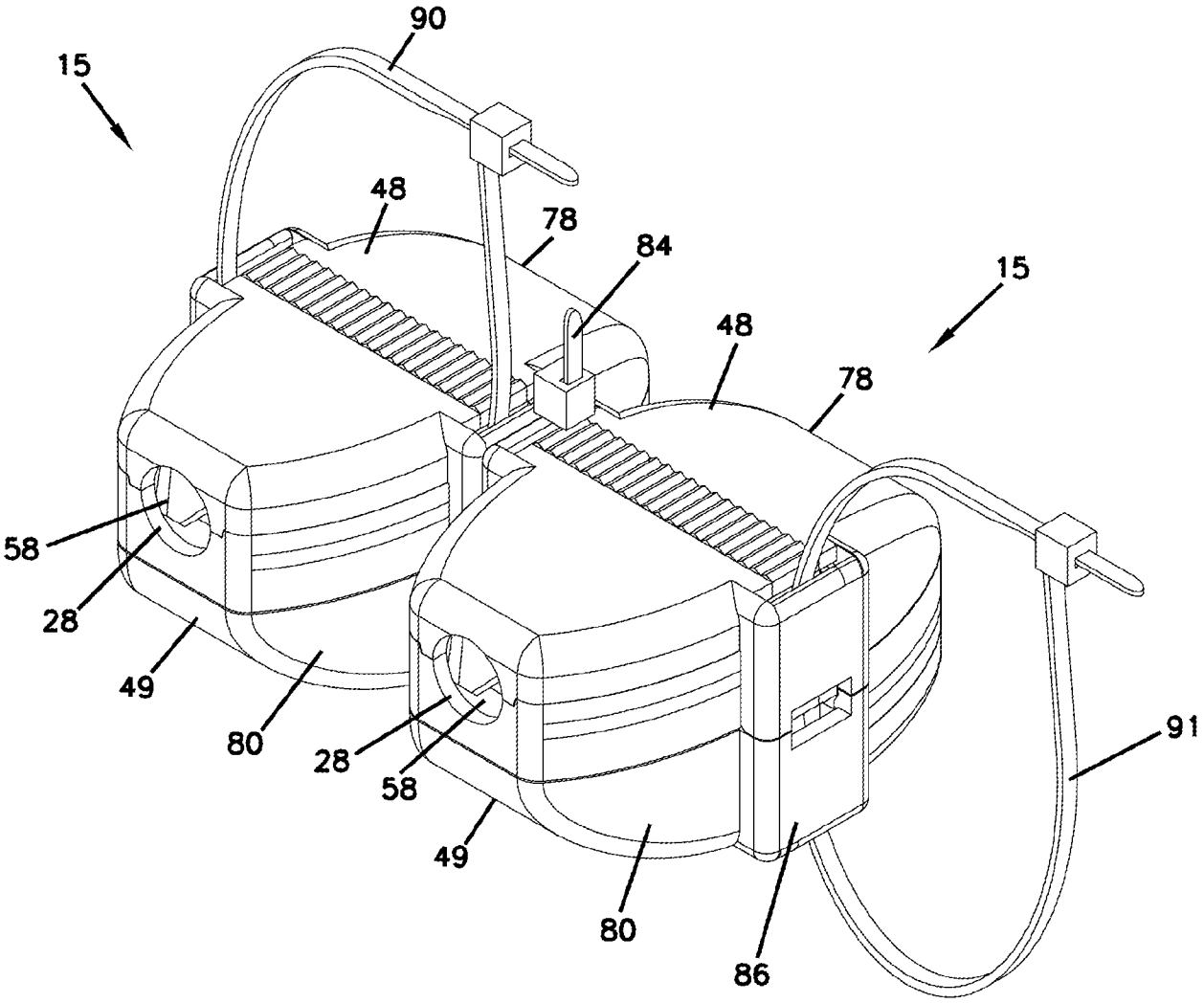
FIG. 11 is a perspective view showing two connector assemblies secured to each other laterally.

In FIG. 11, zip tie 84 is removably connecting two adjacent assembly housings 78. Additional zip ties 90, 91 are also illustrated as being laced between the openings. Zip ties 90, 91 can be used for other purposes, such as securing the assembly housings 78 to additional structure.

Figure 12:
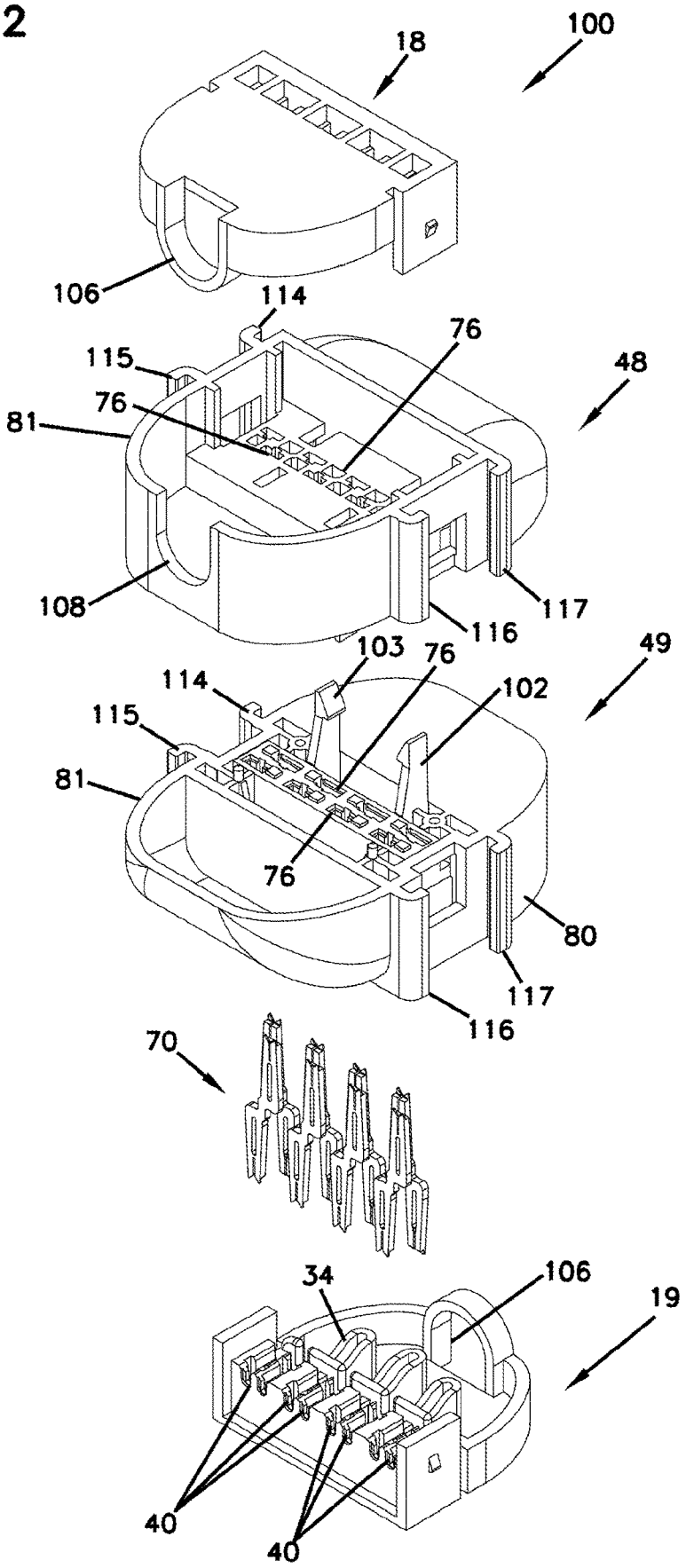
FIG. 12 is an exploded perspective view of another embodiment of a connector assembly.
Figure 13:
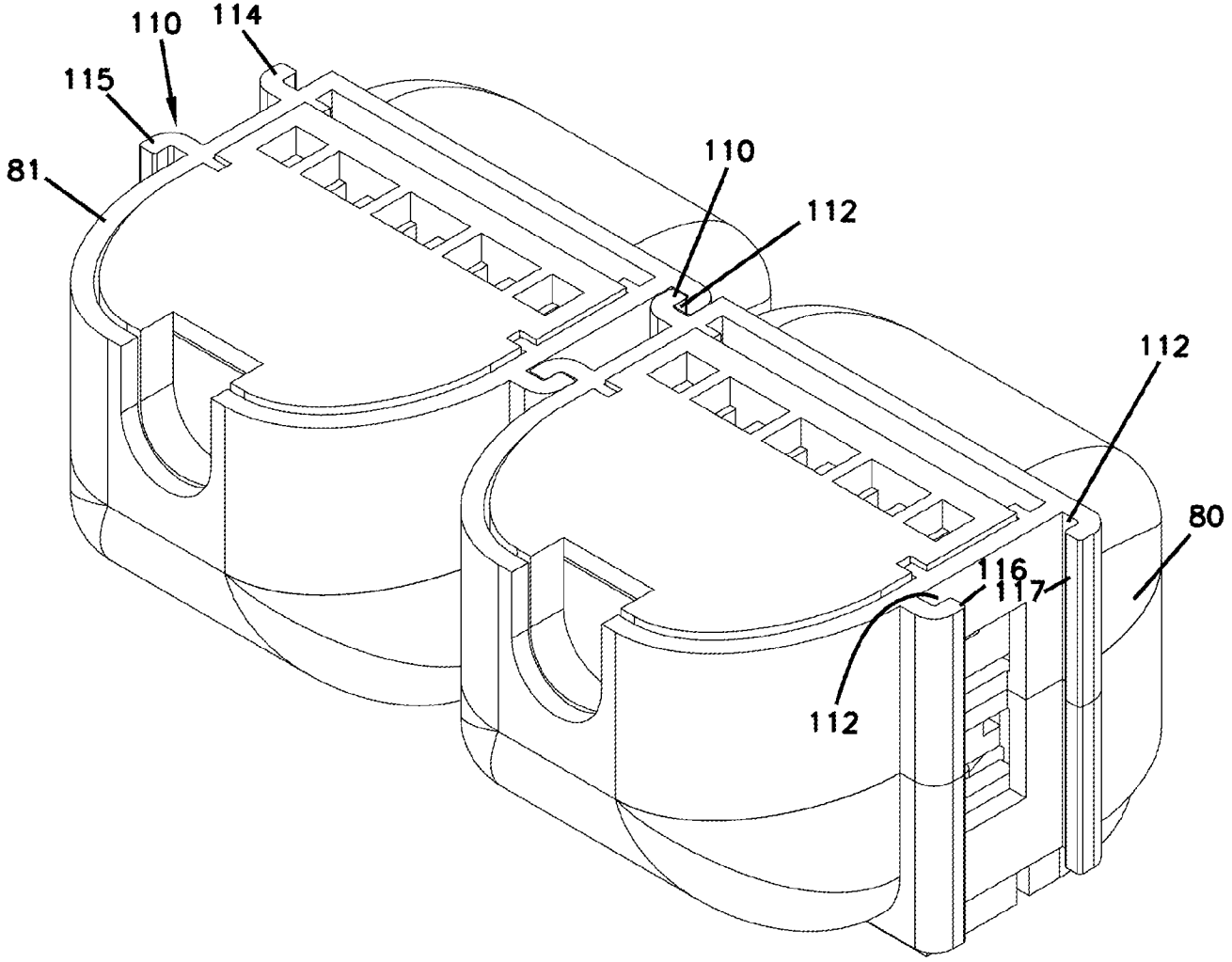
FIG. 13 is a perspective view of two of the connector assemblies of FIG. 12 assembled and connected laterally to each other.

A second embodiment of a connector assembly constructed in accordance with principles of this disclosure is shown in FIGS. 12 and 13 at 100. The connector assembly 100 has many similar features as connector assembly 15, and like parts will have like reference numbers as the first embodiment. Some of the differences from the first embodiment are discussed herein. In this embodiment, the first terminal housing part 18 and the second terminal housing part 19 are the two exterior portions of the assembly 100, while the first and second wiring caps 48, 49 are two of the internal pieces of the assembly 100.

The double ended insulation displacement contacts 70 are operably held within the first and second wiring caps 48, 49. Slots 76 are formed in two rows in the wiring caps 48, 49, rather than in the terminal housing parts 18, 19 of the first embodiment.

The first and second wiring caps 48, 49 are removably latched together using latches 102, 103.

While the connector assembly 15 of the first embodiment has an open sided aperture 28 for receiving the cable, this embodiment has a closed aperture 106 for allowing entry of the cable into the terminal housing parts 18, 19. The closed aperture 106 is received within a groove 108 of the respective wiring cap 48, 49. The cable needs to be threaded within the closed aperture 106.

While structurally, the first terminal housing part 18 and second terminal housing part 19 are identical in the embodiment of FIG. 12, they need to be marked for the technician uniquely such the first terminal housing parts 18 are different from the second terminal housing parts 19 because of how they are marked. In particular, each twisted pair will have, for example, a white cable and a colored cable. The positon of the colored cable and the white cable are opposite for depending on whether they are part of the first terminal housing part 18 or the second terminal housing part 19. A color coding is used for the first and second terminal housing parts 18 and 19 in order to instruct the technician for how to lace the individual leads in a twisted pair.

The assemblies 100 have a connection arrangement to allow for selective removable connection to an adjacent assembly. This can be seen in FIG. 13. In FIG. 13, the connection arrangement includes a projection 110 from one of the first and second sides 80, 81 and a projection receiving groove 112 in the other of the first and second sides 80, 81. This allows for slidable engagement between adjacent assemblies 100. The projection 110, in this embodiment, includes a pair of curved ribs 114, 115 projecting from second side 81. A pair of slide grooves are formed by projecting ribs 116, 117 extending from the first side 80. The projecting ribs 114, 115 curl away from each other and are received within grooves 112 formed by ribs 116, 117 that are curved toward each other. Many embodiments are possible.

Figure 14:
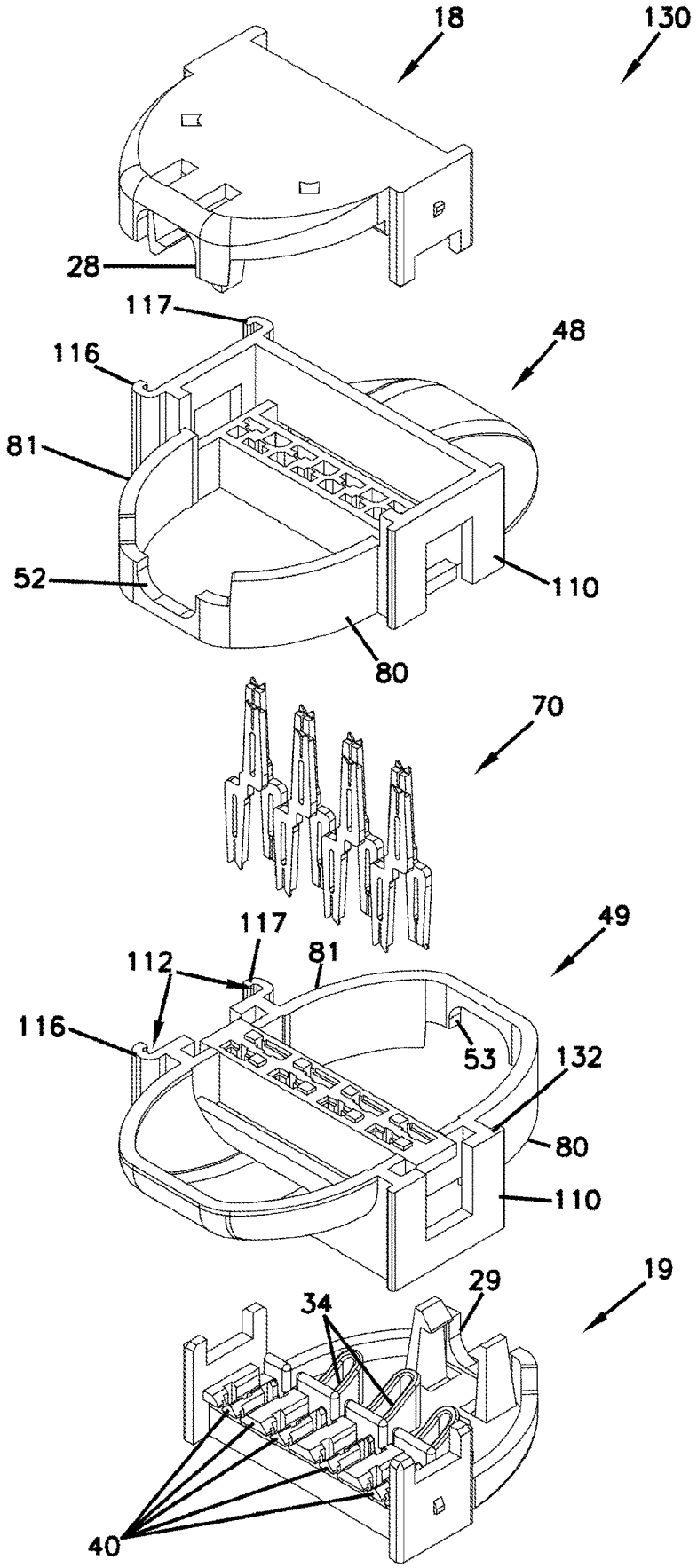
FIG. 14 is an exploded perspective view of another embodiment of a connector assembly.

FIG. 14 shows another embodiment of connector assembly at 130. Assembly 130 is similar to the construction of assembly 100 in FIG. 12, with a few differences, to be discussed herein. The first and second terminal housing parts 18, 19 have open sided apertures 28, 29 similar to the embodiment of the connector assembly 15.

In this embodiment, the connection arrangement to allow for selective removable connection to adjacent housing assemblies 130 includes projection 110 in one of the first and second sides 80, 81 and projection-receiving groove 112 in the other of the first and second sides 80, 81. In this embodiment, the receiving groove 112 is formed by ribs 116, 117 that curled toward each other to contain the groove 112 therewithin. The projection 110 is formed by a T-shaped flange 132 that is sized to be received within the groove 112.

Otherwise, the assembly 130 is structured similarly to the assembly 110.

Another embodiment of a connector assembly constructed in accordance with principles of this disclosure is shown in FIGS. 17-21 at reference numeral 200. The connector assembly 200 has many similar features as connector assembly 15, and like parts will have like reference numerals as the first embodiment. Some of the differences from the first embodiment are discussed herein.

Figure 21:
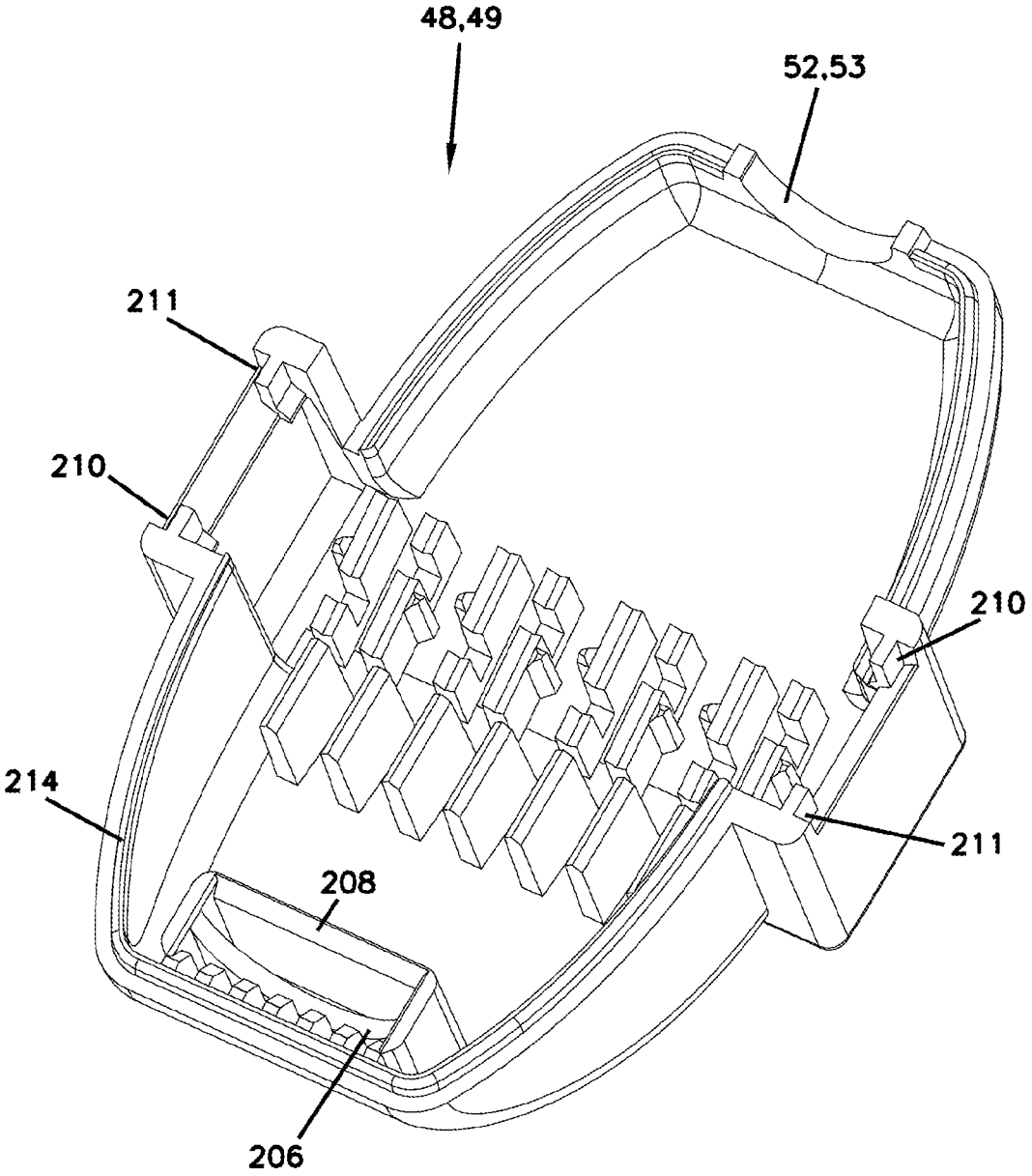
FIG. 21 is a perspective view of one of the wiring caps used for the connector assembly of FIGS. 17-19.

In this embodiment, there is a provision for an internal cable tie for strain relief. In particular, attention is directed to FIGS. 19-21. Each of the terminal housing parts 18, 19 includes a pair of apertures 202, 203 that allows the passage of a cable tie therethrough. There is a routing feature in the form of a curved track or groove 206 in each of the wiring caps 48, 49. The track or groove 206 is contained by a wall 208 (FIG. 21). This routing feature in the wiring cap 48, 49 permits the cable tie to be installed while the opposite side cap 49, 48 is already installed. This can be appreciated from a review of FIG. 19. The cable tie will be put through one of the apertures 202, 203, and slid along the groove 206 until it emerges from the opposite aperture 203, 202.

Another feature of connector assembly 200 includes a modification to the slots 69 that allow disassembly with a screwdriver. The slot 69 further includes indents at 210, 211 to permit the wiring caps 48, 49 to be removed using a thumbnail or fingernail.

Again in reference to the assembly 200, another difference from the embodiment of FIG. 1 is the inclusion of an overlapping lip 214 on the wiring caps 48, 49. The lip 214 is for further environmental protection along the seams where the wiring caps 48, 49 mate with the terminal housing parts 18, 19. In other aspects, the assembly 200 is structured similarly to the assembly 15.

The connection arrangement (e.g., each connector assembly 15, 100, 200) as described herein is capable of compliance with Category 6A, which is a set of minimum requirements specified in the "568-C.2 TIA Standard" for twisted pair telecommunication cabling components used in building and campus telecommunication networks. In such networks, the information signal is normally transmitted over a pair of conductors, known as the "tip" conductor and the "ring" conductor, as a voltage difference between the two conductors. This type of signal is known as a differential mode signal. Under certain conditions another type of signal may exist on the pair whereby the same voltage is applied to the two conductors. This type of signal is known as a common mode signal.

The reason why differential mode signaling is the method of choice for carrying the information signal on a twisted pair is that such a signal is not affected by far field electrical noise from external sources since such noise elevates the voltages of both conductors equally. When the information signal on a twisted pair passes through a pair of contacts in a multi-pair connector, however, asymmetry between these contacts and the contacts of an adjacent pair, depending on the contact array geometry, causes a portion of this signal to couple unequally to the adjacent pair causing both differential and common mode disturbances known as differential mode and common mode crosstalk. The combination of disposing the contacts, as described above, into two rows, as shown in FIG. 1, and having an internal jog 74 in each of them, as shown in FIG. 4, results in a staggered arrangement which positions each contact in one pair approximately equidistant to the two contacts in an adjacent pair enabling the contacts to self-compensate for differential crosstalk. Furthermore, this geometrical configuration causes the contacts of each pair to cross over each other, as can best be seen in FIG. 25. Placing this cross-over in the middle of the contact pair allows the contacts to also self-compensate for common mode crosstalk due to opposite proximities of the tip and ring of one pair to both conductors of an adjacent pair between the lower and upper halves of the contact pairs (e.g., common mode crosstalk generated in the lower half on the second pair due to "tip" of the first pair being closer to it than "ring" of the first pair is compensated by common mode crosstalk generated in the upper half on the second pair due to "ring" of the first pair being closer to it than "tip" of the first pair).

Several features (e.g., the spacers, etc.) of the various embodiments ensure that the twisting of the cable pairs is maintained to within a very short distance, e.g. under 4 mm. This feature leads to advantage because any un-twisting of adjacent pairs causes differential and common code crosstalk between them that is difficult to compensate for because of the unpredictability of its magnitude and the excessive time delay between where it occurs and where it can be compensated for in the connector.

Figure 22:
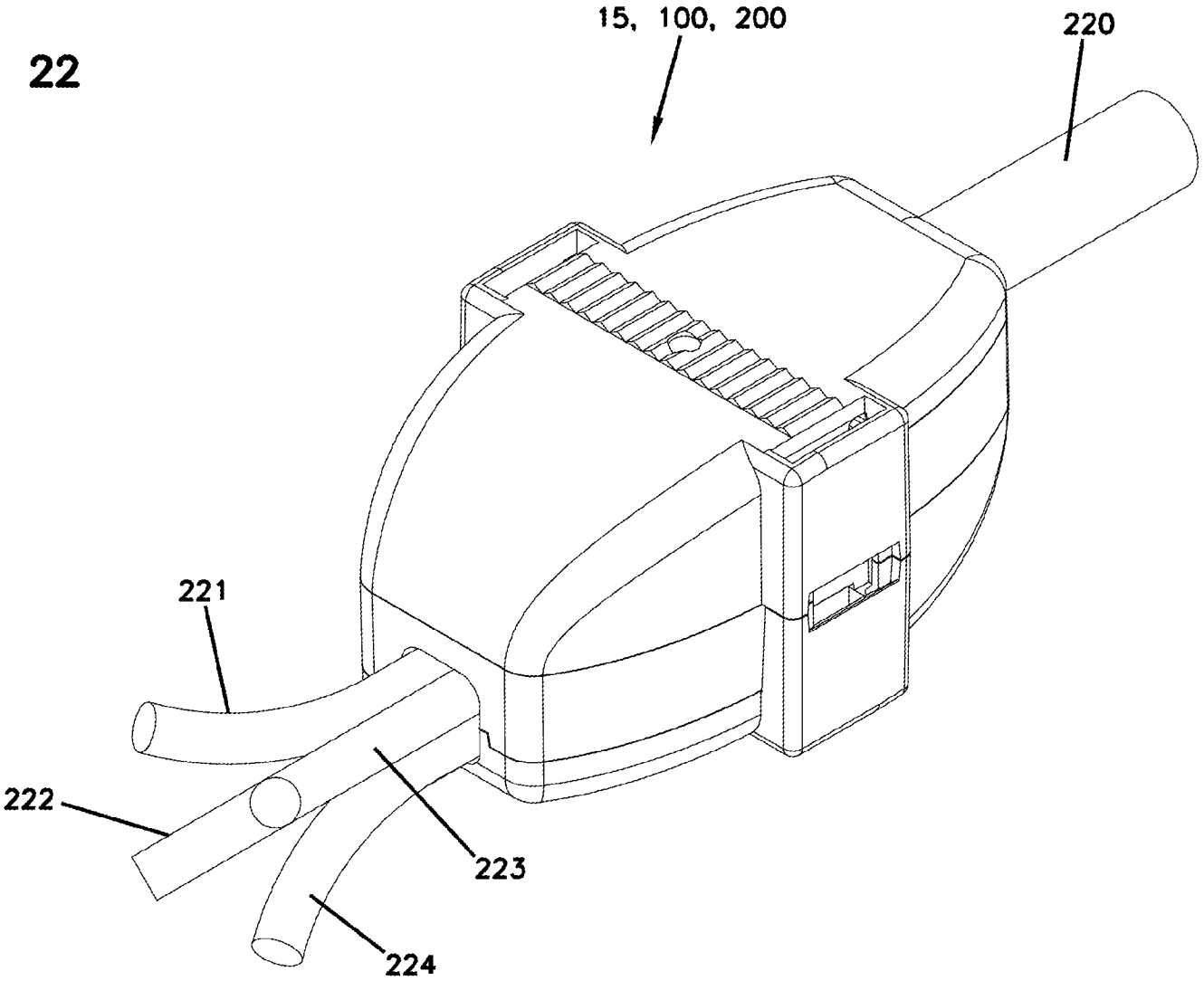
FIG. 22 is a perspective view of the connector assembly shown connecting one 4-pair cable to four 1-pair cables.
Figure 23:
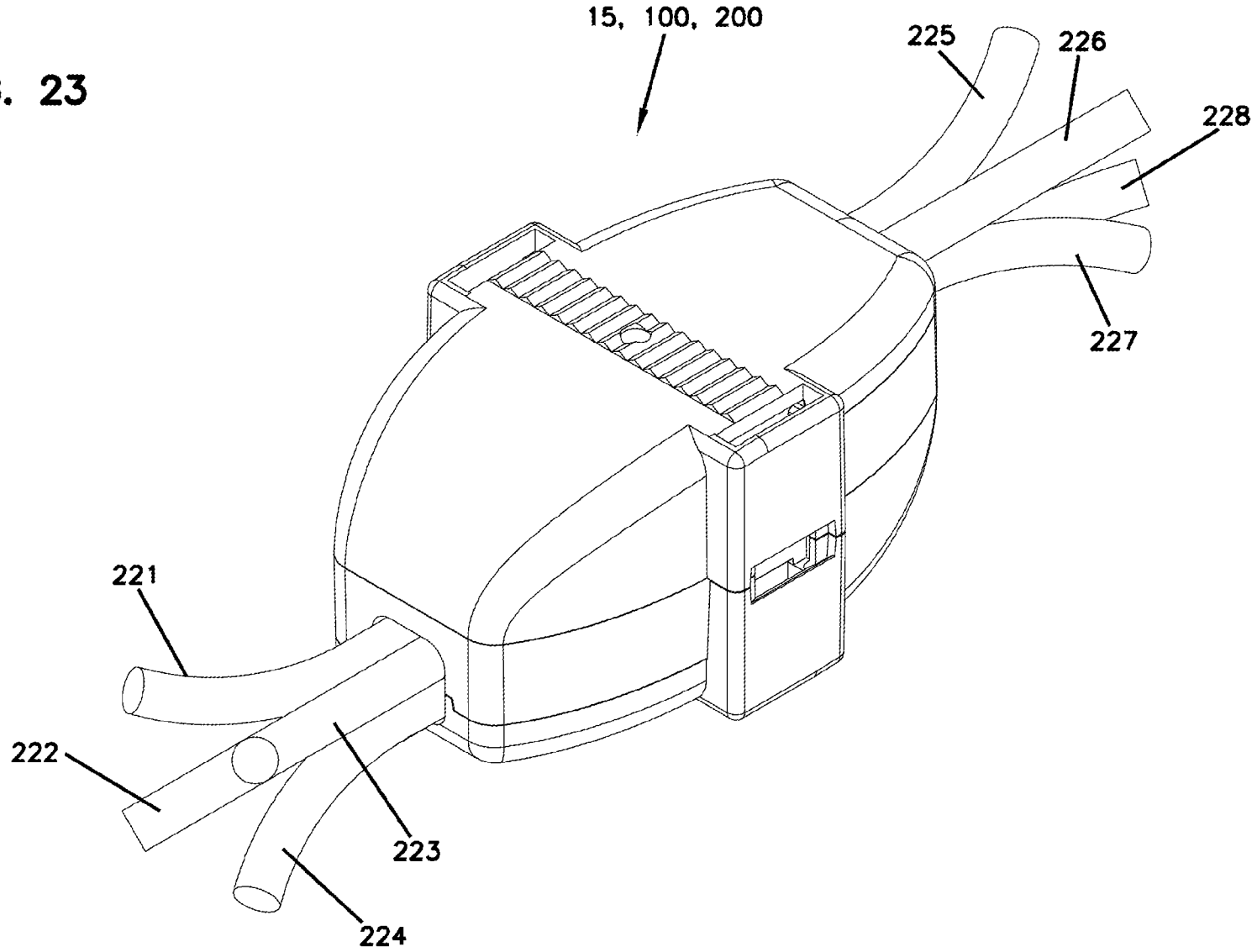
FIG. 23 is a perspective view of the connector assembly shown connecting four 1-pair cables to four 1-pair cables.
Figure 24:
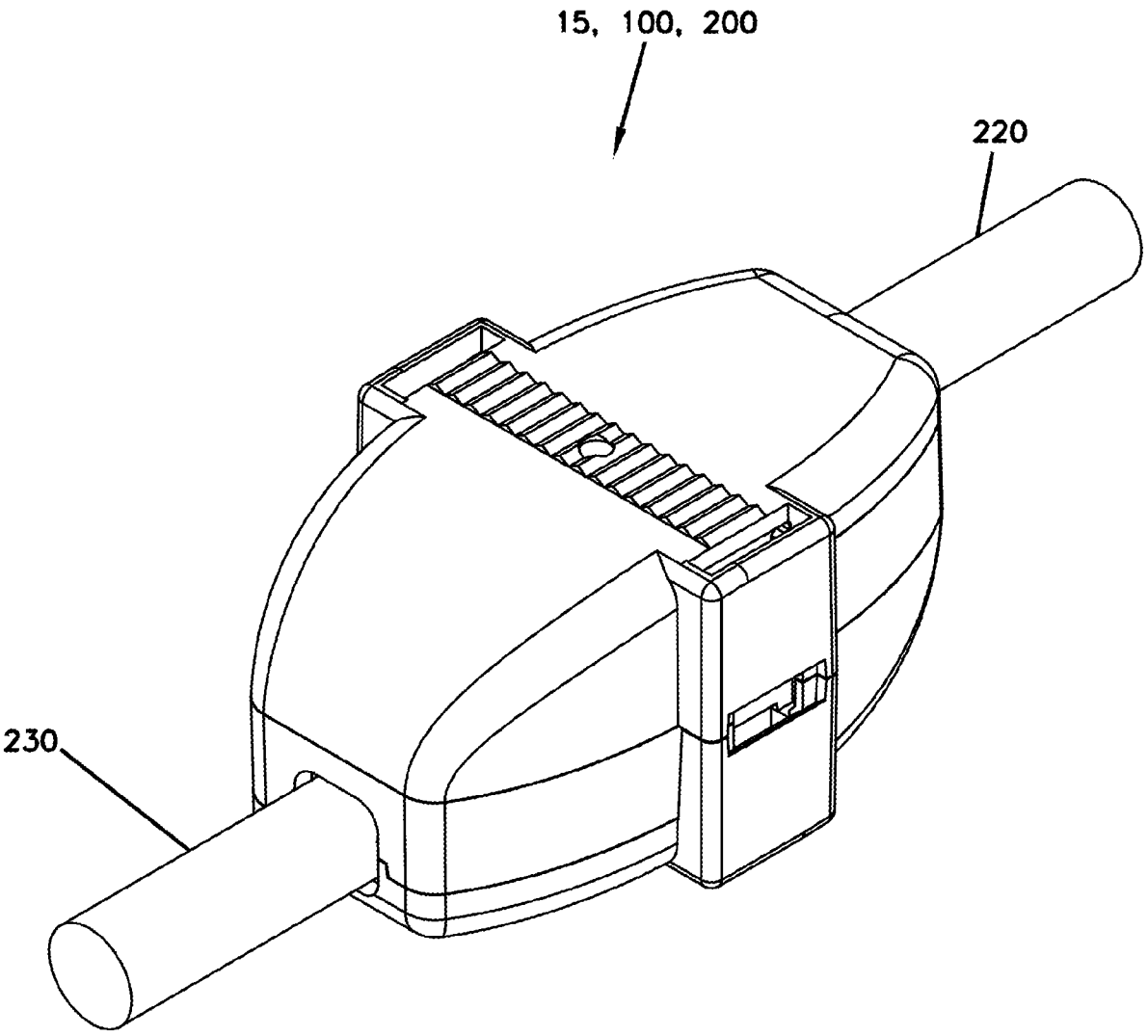
FIG. 24 is a perspective view of the connector assembly shown connecting one 4-pair cable to one 4-pair cable.

A method of connecting inline one or more pairs of wire leads of a first cable to one or more pairs of wire leads of a second cable can be followed using the principles described herein. For example, as shown in FIG. 22, the connector assembly 15, 100, 200 can connect one 4-pair cable 220 to four 1-pair cables 221, 222, 223, 224. As shown in FIG. 23, the connector assembly 15, 100, 200 can connect the four 1-pair cables 221, 222, 223, 224 to four 1-pair cables 225, 226, 227, 228. As shown in FIG. 24, the connector assembly 15, 100, 200 can connect the one 4-pair cable 220 to another one 4-pair cable 230.

The method includes lacing one or more pairs of wire leads into first terminal housing part 18. For example, In FIG. 3, it can be seen that the cable 32 has four twisted pairs of wire leads. The twisted pair is maintained for as long as possible in order to avoid crosstalk. Each twisted pair is separated by spacer 34 and then ultimately separated into the individual lead by leads spacers 40. The method includes lacing a one or more pairs of wire leads into second terminal housing part 19, in which the first and second terminal housing parts 18, 19 are substantially identical to each other.

The method includes providing first wiring cap 48 against the first base 21 of the first terminal housing part 18. The method includes providing second wiring cap 49 against the second base 22 of the second terminal housing part 19.

The method includes compressing the assembly of the first terminal housing part 18, the first wiring cap 48, the second terminal housing part 19 and the second wiring cap 49 so that it plurality of double ended insulation displacement contact 70 within the assembly 15 penetrate the insulation of the wire leads and electrically connect the one or more pairs of the first cable to the one or more pairs of the second cable.

The step of compressing can be accomplished without the use of specialized tool. For example, the step of compressing can include using standard pliers, such as ChannelLock® tongue and groove pliers to compress against the first wiring cap 48 and second wiring cap 49 and squeeze the assembly together to allow the insulation displacement contact 70 to displace the insulation and make electrical contact with the leads.

The method may also include laterally attaching adjacent assemblies 15 to each other. For example, one assembly 15 may be placed laterally next to another assembly and then a tether or zip tie 84 can be used to hold the two assemblies together. The zip tie 84 can be placed in an open channel formed between the housing parts 18, 19 and the respective wiring caps 48, 49.

The above represents inventive principles. Many embodiments can be made utilizing these principles.

What is claimed is:

1. An inline cable connector assembly for connecting one or more pairs of wire leads of a first cable to corresponding one or more pairs of wire leads of a second cable, the connector assembly comprising:

(a) a terminal housing structure including a first base and a second base, the first base being identical to the second base, the second base facing a direction opposite the first base, and each of the first and second base including a plurality of contact-holding slots;

(b) a wiring cap structure including first and second wiring caps; the first wiring cap being oriented to engage against the first base and the second wiring cap being oriented to engage against the second base, the first and second wiring caps being identical; and (c) one or more pairs of double ended insulation displacement contacts within the connector assembly and held by respective contact-holding slots, wherein each of the double ended insulation displacement contacts is defined by an elongate axis extending between the ends of each of the double ended insulation displacement contact and wherein the elongate axis of each of the double ended insulation displacement contact is perpendicular to one or both of an elongate axis of the terminal housing structure and the wiring cap structure.

2. The connector assembly of claim 1, wherein each of the first and second base includes four slots in a row sized to hold a pair of wire leads, and eight slots in a row next to and downstream of the four slots, the eight slots being sized to hold a single wire lead.

3. The connector assembly of claim 1 wherein the first base is part of a first terminal housing part, and the second base is part of a second terminal housing part; the first and second housing parts being latched together and substantially identical.

4. The connector assembly of claim 1 wherein the terminal housing structure and wiring cap structure together form an assembly housing, the assembly housing including opposite first and second sides, each of the first and second sides having a connection arrangement to allow for selective removable connection to an adjacent assembly housing.

5. The connector assembly of claim 1 wherein:

(a) the first wiring cap is snap-fit engagement with the first base; and (b) the second wiring cap is a snap-fit engagement with the second base.

6. The connector assembly of claim 5 wherein the snap-fit engagement between the first and second wiring caps and the first and second bases is disengageable with at least one of a screwdriver or a fingernail.

7. The connector assembly of claim 5 wherein the snap fit engagement is accomplished with the use of standard pliers.

8. The connector assembly of claim 1 wherein:

the first base is part of a first terminal housing part, and the second base is part of a second terminal housing part.

9. The connector assembly of claim 8 wherein:

the first terminal housing part has an open-sided aperture for allowing entry of the first cable, and the second terminal housing part has an open-sided aperture for allowing entry of the second cable.

10. An inline cable connector assembly for connecting one or more pairs of wire leads of a first cable to corresponding one or more pairs of wire leads of a second cable, the connector assembly comprising:

(a) a terminal housing structure comprised of identical first and second terminal housing parts;

(b) a wiring cap structure that engages the terminal housing structure, the wiring cap structure comprised of identical first and second wiring cap parts; and (c) first and second rows of double-ended insulation displacement contacts held by the terminal housing structure, each of the contacts having two oppositely directed wire connecting portions electrically connected with an integral jog intermediate the wire connecting portions, wherein each of the double-ended insulation displacement contacts is defined by an elongate axis extending between the ends of the respective double ended insulation displacement contact, and wherein the elongate axis of each of the double-ended insulation displacement contacts is perpendicular to one or both of an elongate axis of the terminal housing and the wiring cap structure.

11. The connector assembly of claim 1, wherein each connector assembly is compliant with Category 6A.

12. A singular inline cable connector for connecting one or more pairs of wire leads of a first cable to corresponding one or more pairs of wire leads of a second cable, the singular inline cable connector comprising:

one or more pairs of double ended insulation displacement contacts defined by an elongate axis extending between the ends of each of the double ended insulation displacement contacts;

a terminal housing structure supporting the one or more pairs of double ended insulation displacement contacts, the terminal housing structure including a plurality of individual wire-holding lead spacers positioned proximate the one or more pairs of double ended insulation displacement contacts, the terminal housing structure comprised of identical first and second terminal housing parts, and the terminal housing structure defined by an elongate axis that is perpendicular to the elongate axis of each of the double ended insulation displacement contacts; and an electrical-connection establishing wiring cap structure that slidably engages the terminal housing structure, the electrical-connection establishing wiring cap structure comprised of identical first and second wiring cap parts.

13. The inline cable connector assembly of claim 10, wherein the identical first and second terminal housing parts face opposite directions.

14. The inline cable connector assembly of claim 13, wherein the identical first and second wiring cap parts face opposite directions.

* * * * *